US008336726B2

(12) United States Patent
Ramsey et al.

(10) Patent No.: US 8,336,726 B2
(45) **Date of Patent: *Dec. 25, 2012**

(54) RESEALABLE BEVERAGE CAN END AND METHODS RELATING TO SAME

(75) Inventors: Christopher Paul Ramsey, Wantage (GB); Christopher Althorpe, Cardiff (GB); Michael Unwin, Bristol (GB); Vincent Manaut, Oxford (GB); Florian Christian Gregory Combe, Oxford (GB); Mark Jonathan Prestidge, Faringdon (GB); Iain Charles Edward Stuart, West Berkshire (GB); Sylvia Maria Farrow, Berkshire (GB); Alexandre Paris, Lecioa (ES)

(73) Assignee: Crown Packaging Technology, Inc., Alsip, IL (US)

( * ) Notice: Subject to any disclaimer, the term of this patent is extended or adjusted under 35 U.S.C. 154(b) by 986 days.

This patent is subject to a terminal disclaimer.

(21) Appl. No.: 12/267,159

(22) Filed: Nov. 7, 2008
(Under 37 CFR 1.47)

(65) Prior Publication Data

US 2009/0173737 A1 Jul. 9, 2009

Related U.S. Application Data

(60) Provisional application No. 60/986,955, filed on Nov. 9, 2007.

(30) Foreign Application Priority Data

Apr. 29, 2008 (GB) ..... 0807762.0
Aug. 22, 2008 (GB) ..... 0815360.3

(51) Int. Cl.
*B65D 17/34* (2006.01)
*B65D 51/18* (2006.01)
*B65D 17/50* (2006.01)

(52) U.S. Cl. ..... 220/254.3; 220/254.9; 220/259.1; 220/269

(58) Field of Classification Search ..... 220/254.3, 220/254.4, 255.1, 258.2, 259.1, 301, 820, 220/254.9, 269
See application file for complete search history.

(56) References Cited

U.S. PATENT DOCUMENTS 3,250,425 A 5/1966 Stec et al.
3,262,612 A 7/1966 Tabor
3,287,053 A 11/1966 Stec et al.
3,386,613 A 6/1968 Traynor
3,406,867 A 10/1968 Westphal et al.

(Continued)

FOREIGN PATENT DOCUMENTS

EP 0088185 A1 9/1983

(Continued)

OTHER PUBLICATIONS

Amtsblatt des Kantons Graubünden, "Hinged, resealable closures for metal can ends", 1996, 2746-2747.

(Continued)

*Primary Examiner* — Mickey Yu
*Assistant Examiner* — Chun Cheung
(74) *Attorney, Agent, or Firm* — Woodcock Washburn LLP

(57) ABSTRACT

A recloseable and resealable beverage can end closure includes a base plate beneath the center panel and a tab plate above the center panel. The closure is slidable relative to the center a panel to uncover the pour aperture and then to position the closure over the pour aperture to enable resealing.

18 Claims, 18 Drawing Sheets

U.S. PATENT DOCUMENTS

| | | | | |
|---|---|---|---|---|
| 3,447,713 | A | | 6/1969 | Stec et al. |
| 3,450,301 | A | | 6/1969 | Stec et al. |
| 3,520,440 | A | | 7/1970 | Kinnavy et al. |
| 3,622,034 | A | * | 11/1971 | Lutzker et al. ..... 220/787 |
| 3,705,670 | A | | 12/1972 | Douty |
| 3,744,662 | A | | 7/1973 | Zundel |
| 3,788,512 | A | | 1/1974 | Brahler |
| 3,871,544 | A | | 3/1975 | Peyser |
| 3,910,410 | A | | 10/1975 | Shaw |
| 3,952,911 | A | | 4/1976 | Bozek et al. |
| 4,054,205 | A | | 10/1977 | Blow, Jr. et al. |
| 4,098,439 | A | | 7/1978 | Blow, Jr. et al. |
| 4,122,970 | A | | 10/1978 | Amabili |
| 4,127,221 | A | | 11/1978 | Vere |
| 4,136,797 | A | | 1/1979 | Potts |
| 4,150,777 | A | | 4/1979 | Cyr et al. |
| 4,266,688 | A | | 5/1981 | Reid |
| 4,361,244 | A | | 11/1982 | Walter |
| 4,369,888 | A | | 1/1983 | Walter |
| 4,397,400 | A | | 8/1983 | Walter |
| 4,397,403 | A | | 8/1983 | Guimarin |
| 4,407,423 | A | | 10/1983 | Walter |
| 4,431,110 | A | | 2/1984 | Roth |
| 4,440,310 | A | | 4/1984 | Heyn |
| 4,462,504 | A | | 7/1984 | Roth et al. |
| 4,540,611 | A | | 9/1985 | Henderson |
| 4,576,306 | A | | 3/1986 | Kelsey et al. |
| 4,681,238 | A | | 7/1987 | Sanchez |
| 4,746,032 | A | | 5/1988 | Huang |
| 4,821,912 | A | | 4/1989 | Wells |
| 4,915,290 | A | | 4/1990 | Robichaud et al. |
| 4,930,654 | A | | 6/1990 | Thibeault et al. |
| 4,951,835 | A | | 8/1990 | DeMars et al. |
| 5,085,338 | A | | 2/1992 | Inagaki |
| 5,148,935 | A | | 9/1992 | Lyon |
| 5,199,591 | A | | 4/1993 | Thibeault et al. |
| 5,199,618 | A | | 4/1993 | Reil et al. |
| 5,242,073 | A | | 9/1993 | Willis et al. |
| 5,335,808 | A | | 8/1994 | Lee |
| 5,351,853 | A | | 10/1994 | Shock |
| 5,622,273 | A | | 4/1997 | Kelly |
| 5,692,633 | A | | 12/1997 | Gordon |
| 5,711,447 | A | | 1/1998 | Plester |
| 5,813,561 | A | | 9/1998 | Chang et al. |
| 5,829,610 | A | | 11/1998 | Rohr |
| 5,947,317 | A | | 9/1999 | Hall |
| 6,065,634 | A | | 5/2000 | Brifcani et al. |
| 6,105,806 | A | | 8/2000 | Stasiuk |
| 6,581,264 | B2 | | 6/2003 | Ohori et al. |
| 6,588,617 | B1 | | 7/2003 | Majcen et al. |
| 6,626,314 | B1 | | 9/2003 | McHenry et al. |
| 6,763,963 | B1 | | 7/2004 | Martin |
| 7,152,766 | B1 | | 12/2006 | Walsh et al. |
| 7,168,586 | B2 | | 1/2007 | Jeon |
| 7,198,168 | B2 | | 4/2007 | Mizuma |
| 2002/0050493 | A1 | | 5/2002 | Ball et al. |
| 2003/0062370 | A1 | | 4/2003 | Ball et al. |
| 2003/0178433 | A1 | | 9/2003 | Adams |
| 2005/0051553 | A1 | | 3/2005 | Li et al. |
| 2005/0115977 | A1 | | 6/2005 | Dibdin et al. |
| 2005/0150889 | A1 | | 7/2005 | Perra |
| 2005/0173453 | A1 | | 8/2005 | Azodi |
| 2006/0163253 | A1 | | 7/2006 | Steadman |
| 2007/0068943 | A1 | | 3/2007 | Ramsey |
| 2007/0145055 | A1 | | 6/2007 | Gardiner |
| 2007/0164026 | A1 | | 7/2007 | Morrissey |
| 2007/0215620 | A1 | | 9/2007 | Kasper |
| 2007/0262079 | A1 | | 11/2007 | Paris |
| 2008/0053997 | A1 | | 3/2008 | Perra |
| 2008/0110887 | A1 | | 5/2008 | Ramsey |
| 2008/0314904 | A1 | | 12/2008 | Perra |
| 2009/0179033 | A1 | | 7/2009 | Ramsey |

FOREIGN PATENT DOCUMENTS

| | | | |
|---|---|---|---|
| EP | 0305598 | A1 | 3/1989 |
| EP | 0828663 | B1 | 12/1999 |
| EP | 1767464 | | 3/2007 |
| FR | 1434827 | A | 6/1966 |
| GB | 2154561 | A | 9/1985 |
| GB | 2320008 | A | 6/1998 |
| JP | 61-48128 | | 5/1994 |
| JP | 2003-054549 | | 2/2003 |
| JP | 2003-112735 | | 4/2003 |
| KR | 2000-17742 | A | 4/2000 |
| NZ | 529214 | | 9/2005 |
| WO | WO 91/10600 | | 7/1991 |
| WO | WO 95/04709 | | 2/1995 |
| WO | WO 96/09968 | | 4/1996 |
| WO | WO 98/36987 | | 8/1998 |
| WO | WO 01/28875 | A1 | 4/2001 |
| WO | WO 02/00512 | | 1/2002 |
| WO | WO 03/062084 | | 1/2003 |
| WO | WO 2007/039367 | A1 | 4/2007 |
| WO | WO 2007/128810 | | 11/2007 |
| WO | WO 2008/068169 | | 6/2008 |
| WO | WO 2008/054636 | | 7/2008 |
| WO | WO 2009/062004 | | 5/2009 |

OTHER PUBLICATIONS

U.S. Appl. No. 12/447,576, filed Apr. 28, 2009, Paris.
U.S. Appl. No. 12/470,909, filed May 22, 2009, Ramsey.
U.S. Appl. No. 11/503,087: Final Rejection, Nov. 2, 2009.
U.S. Appl. No. 11/503,087: Non-Final Rejection, Jan. 22, 2009.
U.S. Appl. No. 11/591,041: Non-Final Rejection, Dec. 23, 2009.
U.S. Appl. No. 11/591,041: Requirement for Restriction/Election, Sep. 2, 2009.
U.S. Appl. No. 11/591,041: Final Rejection dated Jan. 20, 2012, 6 pages.

* cited by examiner

Fig. 10A
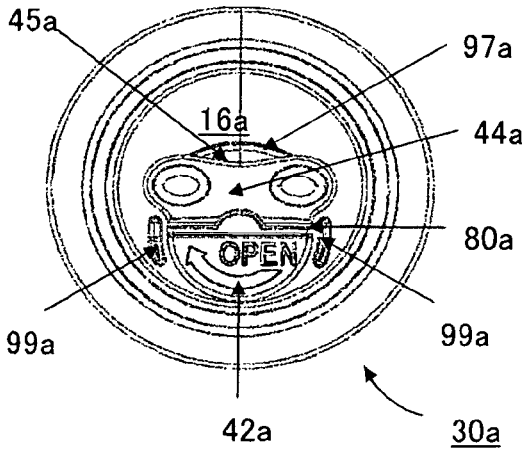
Fig. 10B
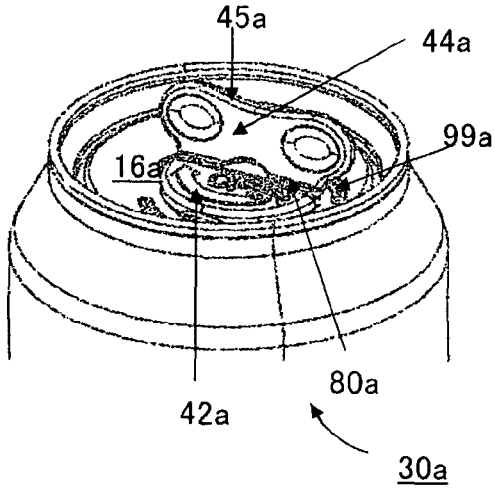
Fig. 11A
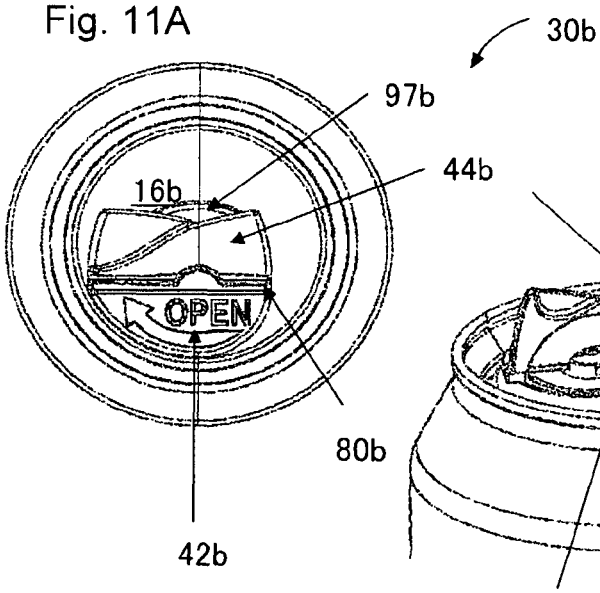
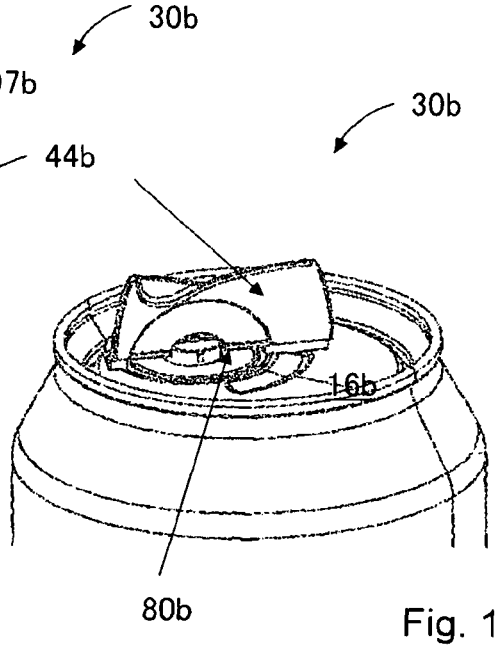
Fig. 11B

RESEALABLE BEVERAGE CAN END AND METHODS RELATING TO SAME

CROSS REFERENCE TO RELATED APPLICATIONS

This application claims priority to Great Britain Application Number 0807762.0 filed Apr. 29, 2008, Great Britain Application Number 0815360.3 filed Aug. 22, 2008, and U.S. Provisional Application No. 60/986955, filed Nov. 9, 2007, each of which is incorporated herein by reference in its entirety.

FIELD OF TECHNOLOGY

The present invention relates to packaging for beverages and, more particularly, to a resealable beverage can end, a resealable closure, and methods relating to same.

BACKGROUND

The structure and functionality of commercial beverage cans have been optimized over the years. Yet commercial beverage cans have the drawback of being unable to reclose after initial opening. Reclosing beverage cans is made more difficult by the dissolved carbon dioxide or other gases in a carbonated beverage that leaves the solution and tends to increase the pressure in the headspace. Several resealable can end designs have been proposed by the prior art, but none have reached commercial acceptance.

Consumers of beverages in plastic bottles, on the other hand, often reseal the bottle by screwing its threaded closure onto the bottle finish. This attribute appeals to consumers.

Accordingly, there is a need for a resealable beverage can that is easy or intuitive to use, has a viable cost, and is not overly complex.

Furthermore, conventional beverage cans are designed to vent the excess pressure in the can upon initial opening. Ends used for such beverage cans have a score line defining an aperture from which the contents of the can may be dispensed and a smaller score line defining a vent. As the tab is lifted, first the vent score severs, allowing release of the gases that have built up in the headspace of the beverage can, and then the aperture score ruptures, to define an aperture through which the contents of the beverage can ma be dispensed. Thus, a user simply lifts the tab to effect both venting and thereafter opening of the beverage can.

The opening device described in WO 2007/128810 assigned to Crown Packaging Technology, Inc. describes an embodiment in which the tab includes a pin, which engages in a vent hole in the end panel. A disadvantage of this arrangement is that upon re-closing of the device, a user must manually reinsert the pin into the vent hole to reseal the can end to prevent leaks and maintain carbonation (if any) of the product inside the container to which the opening device is applied.

SUMMARY

Benefits of a recloseable beverage can end may include the ability to store a portion of the beverage for later use, security, cleanliness, and maintenance of the carbonation level of the beverage even if the beverage is intended to be consumed in one sitting. This may require confidence of the user that the beverage can has been properly re-closed, to maintain the carbonation level of the beverage, and to provide security against spills if the re-closed beverage can is placed in a bag, for example. However, ease of opening of the beverage can, if the beverage is intended to be consumed in one sitting, should be retained.

Accordingly, a re-sealable can end/beverage can is provided that provides one or more of the above identified advantages. In one embodiment, such a can end combination may include a metal can end and a resealable closure coupled to the can end. The can end may include a peripheral wall and a center panel, and the center panel may include an upper surface, an opposing lower surface, and an aperture formed therethrough. The closure may include a base plate and a top plate coupled to the base plate at a first location. The closure may have (i) a sealed position in which at least one of the base plate and top plate contact the center panel about the aperture to form a seal, (ii) an intermediate position in which the closure is proximate the aperture but not sealed, and (iii) a fully open position in which the aperture is exposed to enable pouring liquid through the aperture. The base plate may be downwardly moveable relative to the top plate when moved from the sealed position to the intermediate position. The base plate and top plate may translate together relative to the can end from the intermediate position to the fully open position and may also translate together relative to the can end from the fully open position to the intermediate position. The base plate may be upwardly moveable into engagement with the center panel from the intermediate position into a resealed position forming at least one of a bore seal and a flange seal.

BRIEF DESCRIPTION OF THE FIGURES

The present technology provides a re-closeable end for a beverage can and related methods for making and using the re-closeable end. The technology will now be described in more detail, by way of example only, with reference to the accompanying drawings, in which:

FIG. 10A is a top view of a first alternative top plate configuration, in a closed position, that may be employed with first embodiment closure;

FIG. 10B is a perspective view of the top plate configuration shown in FIG. 10A showing the closure in an intermediate position;

FIG. 11A is a top view of a second alternative top plate configuration, in a closed position, that may be employed with first embodiment closure;

FIG. 11B is a perspective view of the top plate configuration shown in FIG. 11A showing the closure in an intermediate position;

DETAILED DESCRIPTION

The present invention provides a recloseable end for a beverage can and related methods for making and using the recloseable end. The embodiments described below illustrate several aspects of the present inventions and are not intended to be limiting.

Figure 1A:
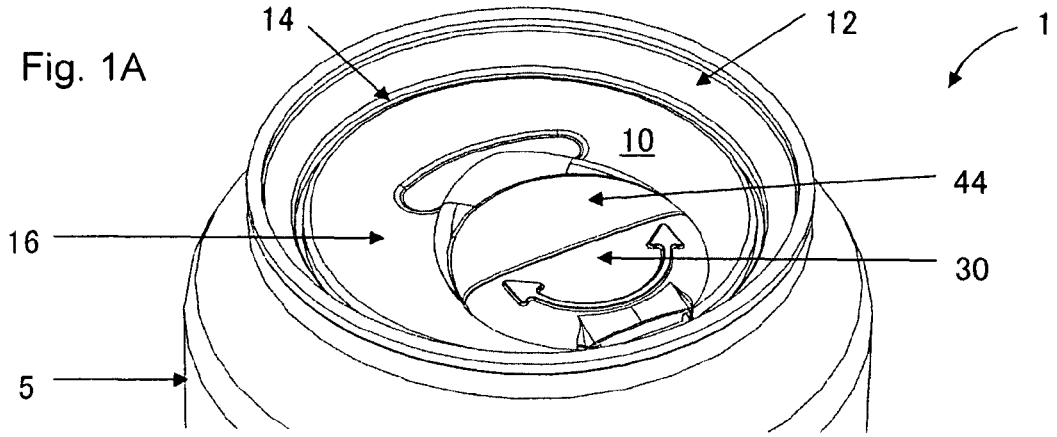
FIG. 1A is a perspective view of a combination can end and a resealable closure illustrating a first embodiment in the fully closed position.
Figure 1B:
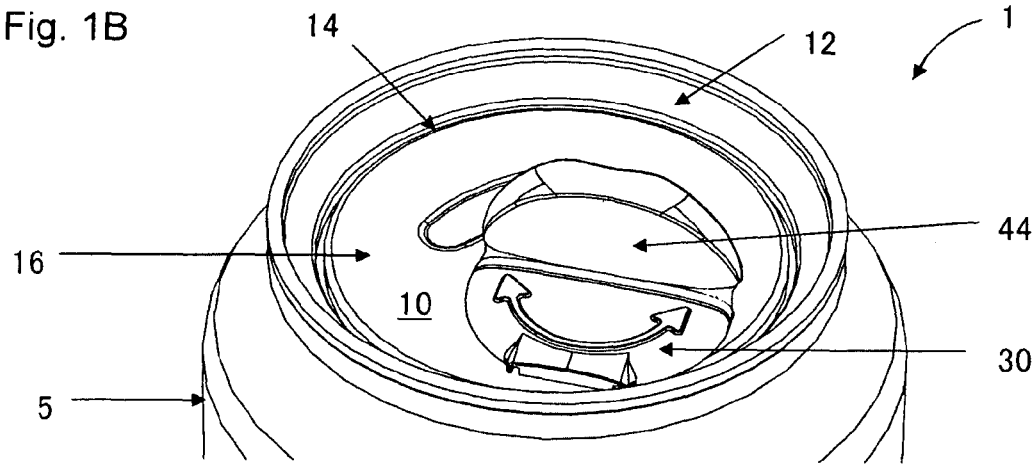
FIG. 1B is a perspective view of the first embodiment in an intermediate position.
Figure 1C:
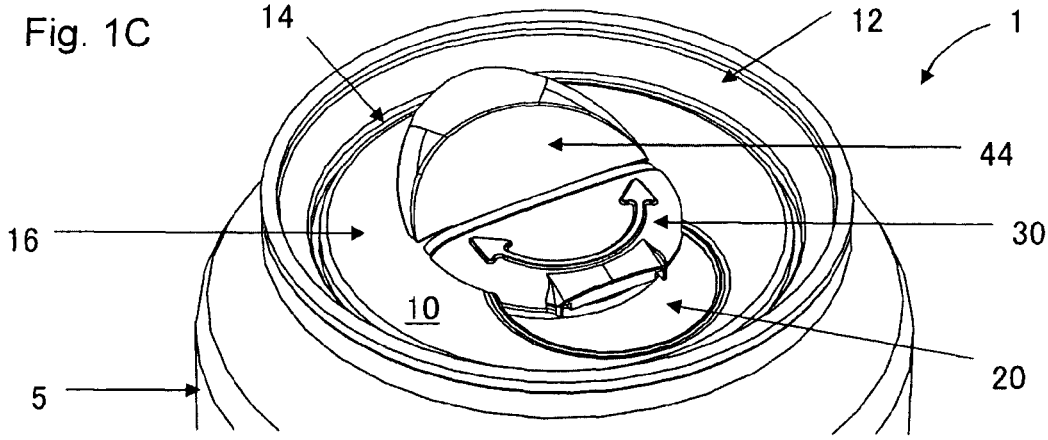
FIG. 1C is a perspective view of the first embodiment in the fully open position.

Referring to FIGS. 1A through 1C, a re-closable beverage can 1 includes a conventional, hollow body 5 and a re-closable end 10. The recloseable end 10 includes a peripheral wall 12, a countersink 14 at the base of wall 12, a center panel 16, and a closure 30. The present invention encompasses both unseamed can ends and can ends seamed onto a beverage can body. Accordingly, can end 10 is shown, for example in FIG. 2A, formed into the shape of a double seam 18, which double seam may be conventional. Preferably, can end 10 is made of conventional end stock material of conventional thickness.

As shown in FIG. 1C, end 10 also includes an aperture 20 formed in center panel 16. The edge that forms aperture 20 preferably is formed into a curl 22. Aperture 20 is shown in the figures as circular and located in the center panel in approximately the same location as opening in a conventional beverage can end. The present invention, however, is not limited to such configuration.

Figure 2A:
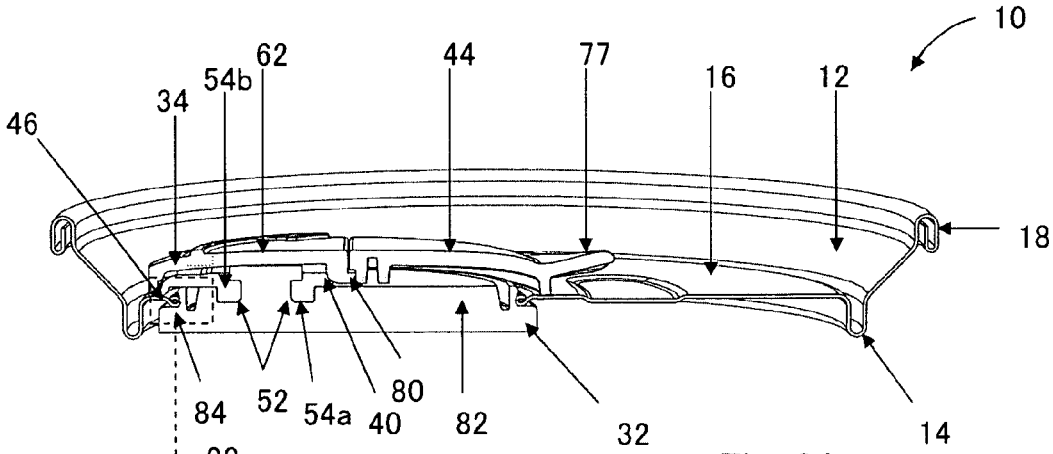
FIG. 2A is a cross sectional view of the first embodiment in its fully closed position.

First embodiment closure 30, as shown for example in FIG. 2A, includes a base plate 32 and a top plate assembly 34. As explained more fully below, closure 30 is mounted onto end 10 such that closure 30 forms a bore seal 36 and a face seal 38 with the curl 22 around the periphery of the aperture.

Top plate assembly 34 includes an anchor plate 40 that is located between a cover plate 42 and a tab plate 44. A hinge 46 connects anchor plate 40 to cover plate 42. Preferably, top plate assembly 34 is formed of a commercially available thermoplastic that can be injection molded in a unitary piece, as understood by persons familiar with packaging technology.

Figure 3A:
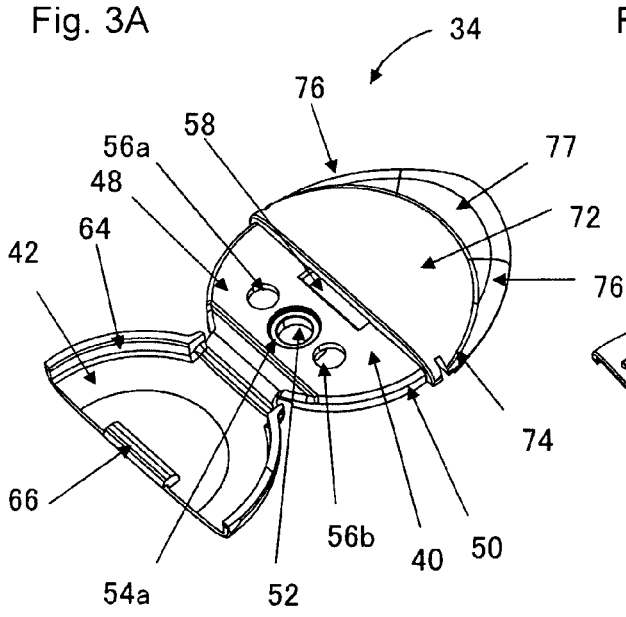
FIG. 3A is a top perspective view of the top plate of the closure of the first embodiment in its pre-assembled state.
Figure 5A:
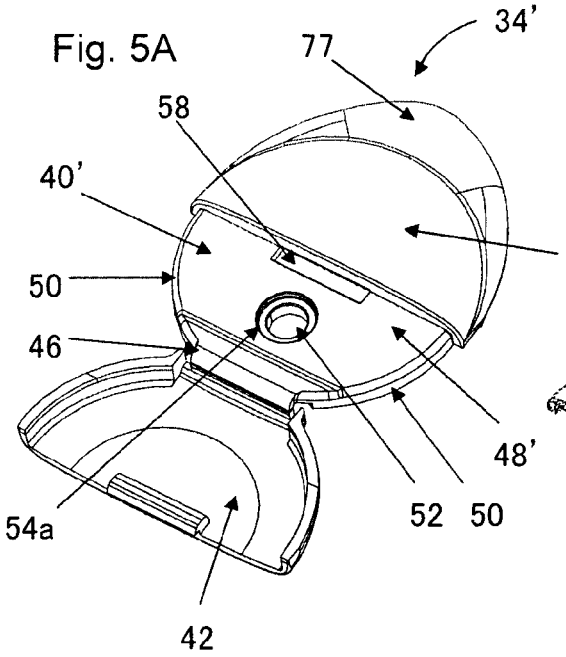
FIG. 5A is a top perspective view of an alternative configuration of the top plate of the closure of the first embodiment in its pre-assembled state.

Anchor plate 40 includes a structural portion or deck 48, which preferably is planar or nearly planar, and a skirt 50 that extends downwardly (as best shown in FIGS. 3A and 5A) from the periphery of the sides of deck 48, 48'. A stake or rivet aperture 52 is formed in deck 48, 48'. Deck 48, 48' also includes a groove or seat 54*a* extending around the circumference of aperture 52 on its topside (for example see FIG. 3A) and a ring 54*b* extending around the circumference of aperture 52 on its underside (for example see FIG. 3B). A pair of post apertures 56*a* and 56*b* are formed in deck 48 and located on opposing sides of stake aperture 52. Preferably apertures 56*a* and 56*b* extend through deck 48. An opening or slot 58 is formed in deck 48 near an end thereof.

Referring to FIGS. 3A, 3B, 5A, and 5B, which show different embodiments of top plate assembly 34, cover plate 42 includes a structural portion or dome plate 62, which preferably is semi-circular and includes a skirt 64 about its periphery on its opposing sides. Skirt 64 has a cutout to accommodate hinge 46 that connects cover plate 42 to anchor plate 40. An elongated tab 66, which preferably has barbs for insertion into and retention by slot 58, extends from the underside of plate surface 62 near an edge opposite of hinge 46. Optionally, a double ended arrow indicator (shown in FIGS. 3B and 5B) may be formed on the topside of plate 62 to indicate an aspect of the function or step for operating closure 30, such as that required for venting, for example.

Figure 3B:
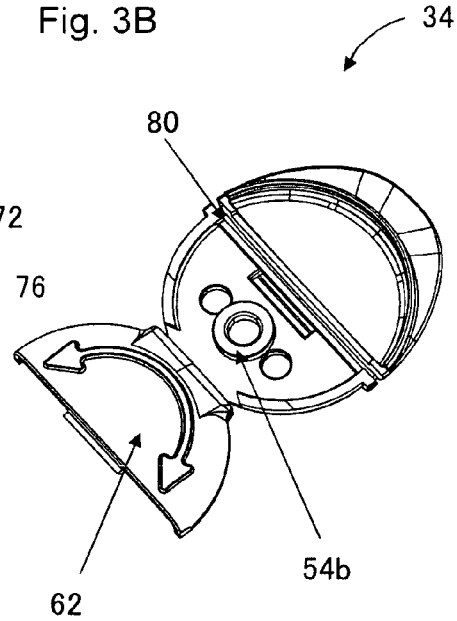
FIG. 3B is a bottom perspective view of the top plate of the first embodiment in its pre-assembled state.
Figure 4A:
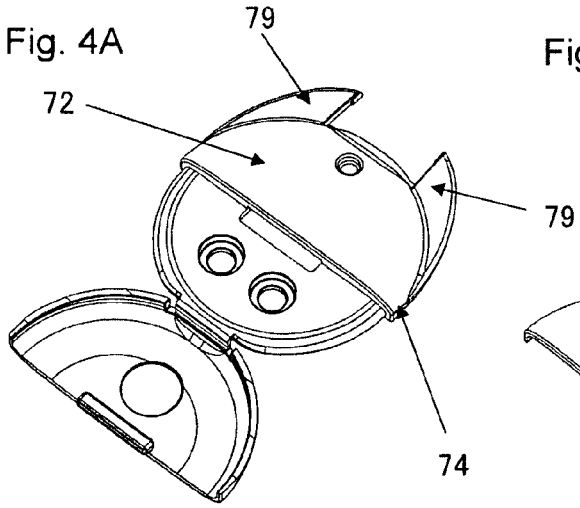
FIG. 4A is a top perspective view of the top plate showing an alternative tab configuration.
Figure 4B:
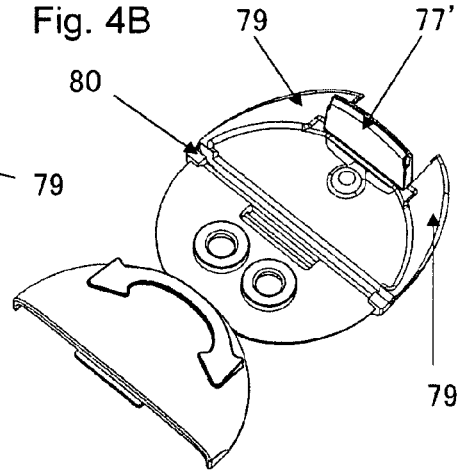
FIG. 4B is a bottom perspective view of the top plate showing an alternative tab configuration.

Tab plate 44 includes a structural portion or dome plate 72 (see FIG. 3A), which preferably is semi-circular and includes a skirt 74 about its periphery. An arcuate extension 76 extends outwardly from a distal end of dome plate 72 and skirt 74, and a tab 77 is formed in extension 76. Tab 77 may be rigid relative to tab plate 44, as shown in FIGS. 3A and 3B. Alternatively, a tab 77', as shown in FIG. 4B, may be formed in extension 76 and hinged to dome plate 72 or skirt 74. Tab 77' is separated from the fixed portion of extension 76 by lateral slits or frangible connections 79.

Figure 5B:
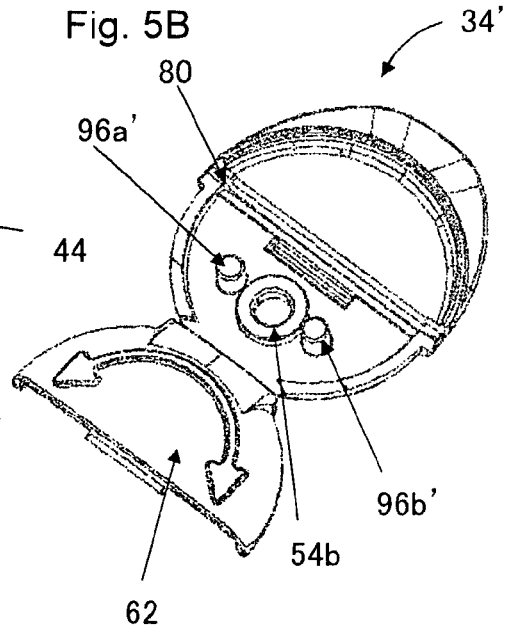
FIG. 5B is a bottom perspective view of the top plate shown in FIG. 5A.

Referring to FIGS. 3B, 4B and 5B, tab plate 44 includes a weakening or groove 80 formed therein, preferably near anchor plate 40 and near the geometric centerline of closure 30. A shoulder, which in the first embodiment is formed by one of the walls forming groove 80, is located between dome plates 62 and 72 of the tab plate 44 and anchor plate 40. In its as-molded, pre-installed position, and in its initial, installed state (that is, before initial opening of closure 30), weakening or groove 80 preferably is not visible when closure 30 is viewed from above, and weakening or groove 80 acts as a living hinge upon actuation of closure 30, as explained more fully below.

Figure 2B:
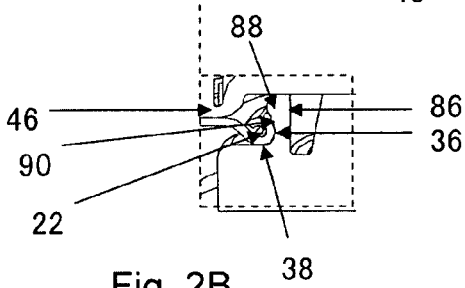
FIG. 2B is an enlarged view of a portion of FIG. 2A depicting a sealing portion of the end.

As best shown in FIGS. 2A and 2B, base plate 32 includes a planar (or nearly planar) plate member 82, a continuous, circumferential flange 84 extending from a periphery of plate member 82, and a continuous ring 86 extending upwardly from flange 84. Base plate 32, flange 84, and ring 86 preferably have approximately the same shape as aperture 20. Accordingly, in the embodiment shown, base plate 32, flange 84, and ring 86 are circular to match the shape of aperture 20.

Figure 6:
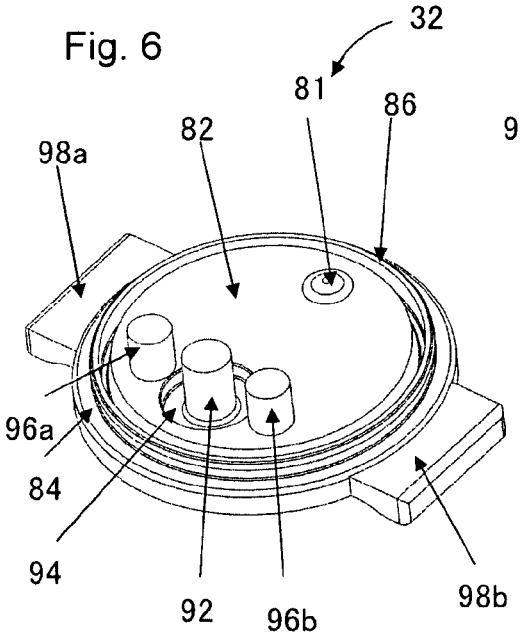
FIG. 6 is a perspective view of a base plate of the first embodiment in its pre-assembled state.

Ring 86, as illustrated in FIG. 2B, includes a bead 88 extending around the outboard side thereof and a recess 90 formed below bead 88. Referring now to FIG. 6, a rivet 92, shown in its as-molded, pre-deformed state in FIG. 10, extends upwardly from plate member 82. A circumferential recess 94 is formed in plate member 82 around rivet 92. A pair of posts 96*a* and 96*b* extend upwardly from plate member 82. A pair of wings 98*a* and 98*b* extend on opposite sides of flange 84. One or more pimples or rounded protrusions 81 extend upwardly from the surface of plate member 82, as shown in FIG. 6.

Figure 2C:
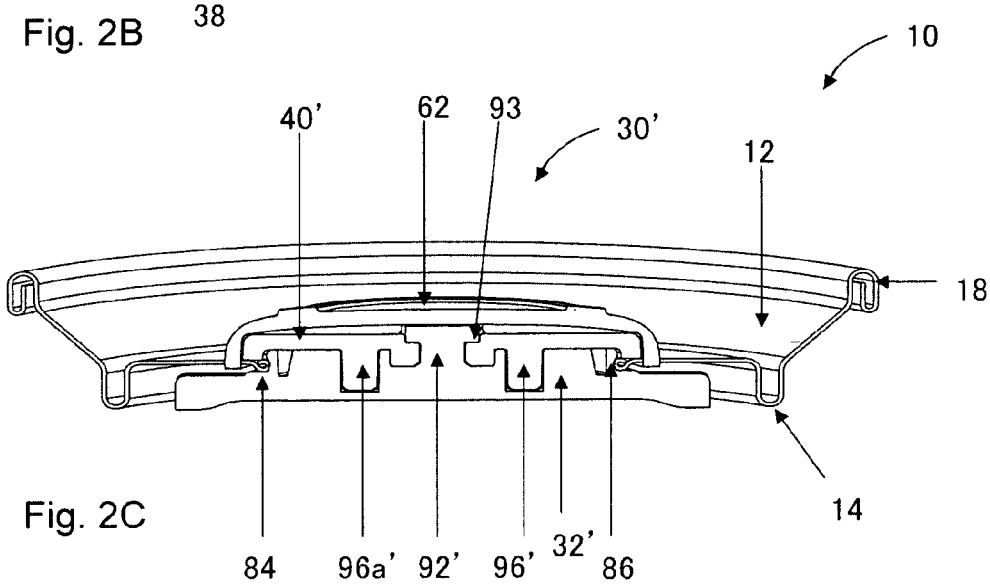
FIG. 2C is a cross sectional view of an alternative embodiment of the can end in it's fully closed position viewed orthogonal to the tab.

Referring to FIGS. 2A through 2C to illustrate closure 30 in its assembled state, the upper edge of seam 18 preferably is above the highest part of closure 30. Accordingly, handling and seaming an end 10 may be accomplished with conventional equipment and technology. The end, except for the opening 20 and closure 30, may be conventional, such as a standard B-64 end or a SuperEnd™ supplied by Crown Cork & Seal Company, Inc. U.S. Pat. No. 6,065,634 describes aspects of the latter end. The present invention also encompasses ends having other configurations; for example and not intending to be limiting, an end having a deeper center panel, a deeper countersink, and/or increased metal thickness compared with a commercial end may be employed according the desired characteristics of the end structure, materials, and function, as will be understood by persons familiar with can end technology.

In its assembled state, base plate 32 is located on the underside of center panel 16 such that the flat surface of flange 84 is in contact with the underside of curl 22 to form face seal 38, and the outboard portion of ring 86 (preferably recess 90) contacts the radially innermost portion of curl 22 to form bore seal 36. In this regard, the outer diameter of flange 84 preferably be larger than the inner diameter of curl 22 to enable engagement therebetween and to retain closure 30 onto center panel 16 even in conditions of high pressure within the can. For example, the beverage can may encounter high temperature, rough handling, or dropping that create a high continuous or transient pressure and result in a large continuous or transient force on closure 30. The location of circumferential flange 84 beneath center panel 16 prevents or decreases the likelihood of the sudden failure (sometimes referred to as "missiling") of the closure upon a high internal pressure condition of this type.

At conventional low pressure conditions, the bore seal 36 is the primary sealing mechanism. For example, for the embodiment shown in FIG. 2A, it is believed that the bore seal 36 is more effective than the face seal 38 below about internal pressures at about 20 psi. At about 20 psi to about 50 psi, the bore seal 36 gradually loses effectiveness because of the elongation or growth of the pour opening as the center panel deflects upwardly into a dome shape. As the bore seal 36 loses, effectiveness, however, the face seal 38 is urged against the underside of center panel 16 with increasing force by the internal pressure, which enhances the effectiveness of the face seal.

Accordingly, it is preferred that closure 30 has both a face seal 38 and a bore seal 36, which work together to seal aperture 20 even when encountering the doming deflection of center panel 16 at expected pressures. Upon venting, the release of internal pressure decreases or eliminates the doming deflection. After resealing, the center panel may again undergo doming due to increased internal pressure caused by the release of dissolved gases from liquid into the headspace, and the bore seal 36 and face seal 38 cooperation is again beneficial.

Ring 86 is sized to be insertable into center panel aperture 20 and is resilient or flexible such that the outer diameter of bead 88 is larger than the diameter of center panel aperture 20. Accordingly, ring 86 preferably undergoes some deflection to move from its initial, as-molded state to its installed state. Further, the installed diameter of ring 86 preferably is smaller than its initial, as-molded diameter (that is, ring 86 preferably engages curl 22 in a snap fit) to enhance the effectiveness of bore seal 36.

Rivet 92 is inserted into stake aperture 52 and in its deformed state is indicated by reference numeral 92' in FIG. 2C. Rivet 92 is deformed to include a head 93 that affixes base plate 32 to anchor plate 40. Deforming rivet 92 to create head 93 may be accomplished by any mechanism and equipment, as will be understood by persons familiar with plastic packaging technology.

To form top plate assembly 34, cover plate 42 is pivoted from its as-molded or pre-installed position, as shown in FIGS. 3A, 3B, 4A, and 4B, relative to anchor plate 40 about hinge 46 such that cover plate 42 is located over anchor plate 40 as shown in FIG. 2B. In its installed position, dome 72 of tab plate 44 and dome 62 of cover plate 42 are oriented to align such that a peripheral edge 68 of cover plate 42 is near or abuts the shoulder or adjacent edge of dome plate 72.

Rivet 92 extends through rivet aperture 52 and head 93 is deformed to engage seat 54*a*. Aperture ring 54*b* on the underside of anchor plate 40 is inserted into annular recess 94 in the base plate, which provides an interlocking engagement between base plate 32 and anchor plate 40 and top plate assembly 34. Anti-rotation posts 96*a* and 96*b* of base plate 32 are inserted into corresponding post apertures 56*a* and 56*b* of anchor plate 40.

Preferably, skirt 64 of cover plate 42 has a contact surface that contacts the upper of the center panel 16 to support cover plate 42. The configuration of the cover plate 42 and its thickness preferably are chosen to resist deflection, and therefore not transmit force or impact to base plate 32, but rather transmit the force or impact to center panel 16. Thus, cover plate 42 prevents or inhibits accidental opening if a downward force or impact is applied to cover plate 42. In this regard, cover plate 42 preferably is relatively rigid compared with anchor plate 40 such that anchor plate 40 enables base plate 32 to deflect downwardly relative at its periphery during the opening process.

Figure 7:
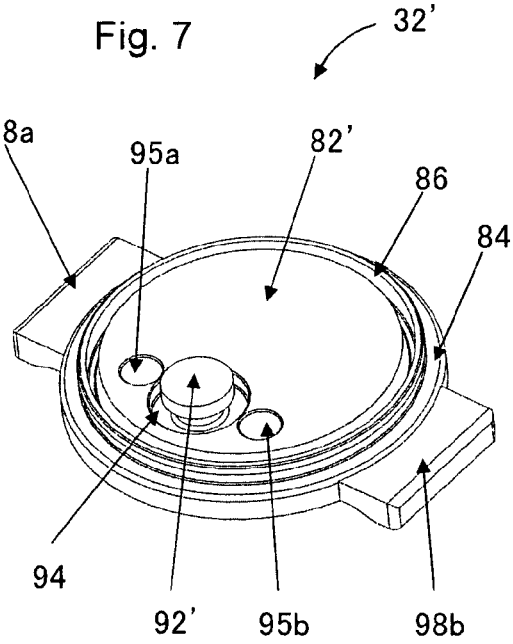
FIG. 7 is a perspective view of an alternative configuration of the base plate corresponding to the top plate illustrated in FIGS. 5A and 5B.

FIGS. 5A, 5B and 7 illustrate an alternative configuration of the top plate assembly and base plate assembly, which are referred to by reference numerals 32' and 34' to distinguish them from the structure shown in FIGS. 3A-4B and 6. Components of the alternative configuration that are the same as those shown in FIGS. 3A and 3B and 5A and 5B are identified by common reference numerals; structure that is different in the alternative configuration from that in the first configuration uses the same reference numeral but is appended with a prime (') to indicate its alternative structure.

Closure 30' includes a base plate 32' and a top plate assembly 34'. Top plate assembly 34' includes an anchor plate 40', a cover plate 42, and a tab plate 44. Cover plate 42 and tab plate 44 may be the same as that described above with respect to FIGS. 3A and 3B.

Anchor plate 40' includes a structural portion or deck 48' which preferably is planar or nearly planar, and a skirt 50 that extends downwardly (as oriented in FIG. 5A) from the periphery of the sides of deck 48'. A groove or seat 54*a* extends around the aperture on its topside and a ring 54*b* extends around the aperture on its underside. A pair of posts 96*a'* and 96*b'* are located on opposing sides of stake aperture 52 on an underside of deck 48'. An opening or slot 58 is formed in deck 48' near an end thereof.

Base plate 32' includes a planar plate member 82', a flange 84 extending from a periphery of plate member 82', and a ring 86 extending upwardly from flange 84. Ring 86 includes a bead 88 extending around the outboard side thereof and a recess 90 formed below bead 88, as described above. A rivet 92, shown in its pre-deformed state in FIG. 6, extends upwardly from plate member 82'. A recess 94 is formed in plate member 82 around rivet 92. A pair of wings 98*a* and 98*b* extend on opposite sides of flange 84. A pair of recess 95*a* and 95*b* are located on opposing sides of rivet 92 on the topside of plate member 82'. Recesses 95*a* and 95*b* may be cup-like or may be through holes.

FIG. 2C is a cross sectional view through closure 30' through rivet 92 and anti-rotation posts 96*a'* and 96*b'* to illustrate the functional relationship of top plate assembly 34' and base plate 32'. In the structure shown in FIGS. 3A-7, posts 96*a* and 96*b* are slideably located in apertures 56*a* and 56*b*.

FIGS. 1A and 2A illustrate first embodiment closure 30 in its installed state before actuation. To operate closure 30, a user places his finger under tab 77 (or tab 77') and lifts up tab plate 44. This lifting action causes tab plate 44 to rotate about weakening or groove 80. Accordingly, the weakening or groove 80 forms and functions as a living hinge. Tab plate 44 preferably is pivoted about the living hinge until it is vertical, thereby enabling tab plate 44 to act as a handle or grip.

The first actuation of the living hinge preferably creates stress whitening at or around weakening or groove 80. The thermoplastic material of top plate assembly 34 may be chosen to ensure that stress whitening is visible and may be chosen to enhance the stress whitening effect. Preferably top plate assembly 34 has a color other than white to enhance the visibility of the stress whitening. Accordingly, the stress whitening of the living hinge provides evidence that closure 30 is not in its as-installed state and had been previously opened. Also, tab plate 44 preferably does not fully reseat to its original, initial position after the first time it is pivoted upward, and in this way provides tamper evidence. The broken condition of the bridges 79 of tab 77' may also provide tamper evidence.

The arrows on the topside of cover plate 42 indicate that upright tab plate 44 may be rotated or twisted in either direction, like the action of turning a dial. Posts 96*a* and 96*b* (or 96*a'* and 96*b'*) transmit torque between top plate 34 (or 34') and bottom plate 32 (32'). The rotation of tab plate 44 causes the entire closure 30 to rotate, which moves one of wings 98*a* and 98*b* against the underside 15 of end countersink 14.

Figure 2D:
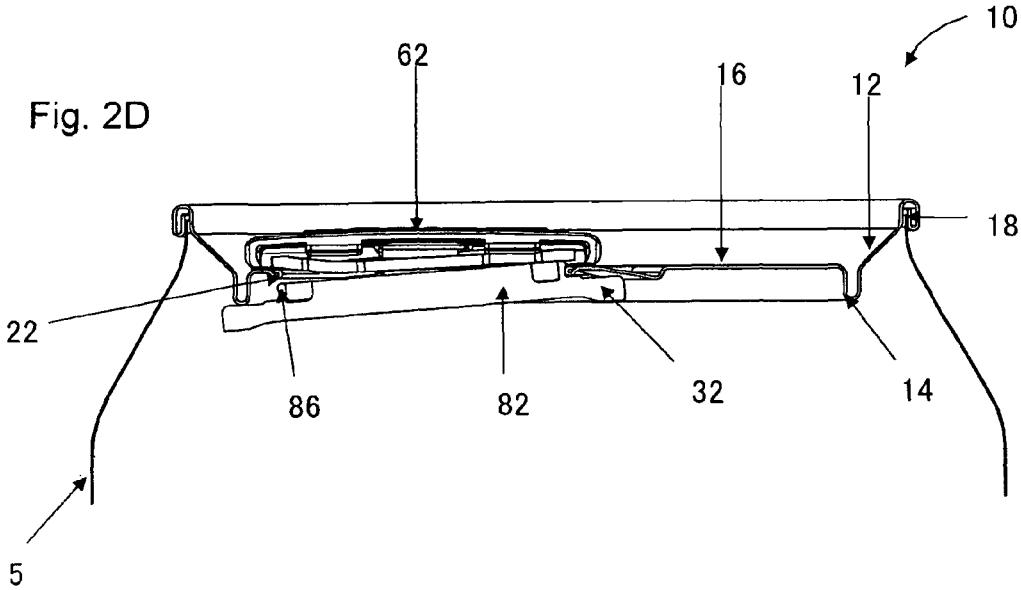
FIG. 2D is a cross sectional view of the first embodiment of the can end in it's intermediate position.

As wing 98*a* or 98*b* is forced beneath countersink underside 15 by the rotation, base plate 32 flexes or tilts to break the bore seal 36 and face seal 38. In this regard, a portion of base plate 32 is displaced relative to center panel 16 such that a portion of ring 86 becomes disengaged from curl 22 as bead 88 is pulled below curl 22 over a portion of its circumference. Breaking the seal in this way enables venting of the pressure in the headspace beneath end 10. The vented position, which is intermediate between the fully closed and fully open positions, is shown in FIGS. 1B and 2D.

From the vented position, the user continues to grip tab plate 44 and pulls or slides closure 30 to expose end aperture 20 to enable drinking or pouring from the can end. Thus, closure 30 may be actuated by gripping tab plate 44, twisting it, and pulling it, without the user letting go of tab plate 44.

Figure 2E:
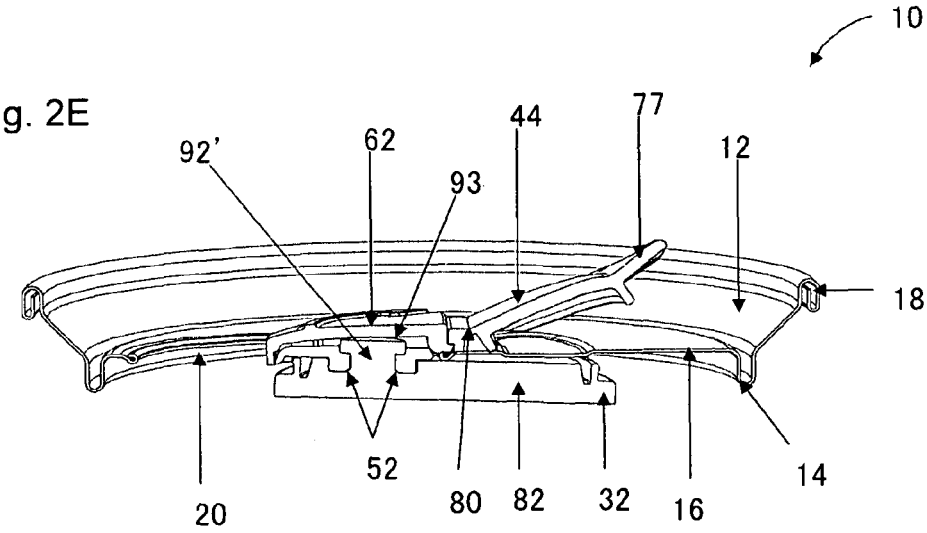
FIG. 2E is a cross sectional view of the first embodiment in its fully open position.

To the extent necessary, the attachment of top plate 34 to base plate 32 by rivet 92 has the inherent capability of flexing to enable base plate 32 to ride underneath center panel 16 and to enable tab plate 44 to ride overtop center panel 16. Posts 96*a* and 96*b* (or 96*a'* and 96*b'*) are longitudinally slideable in corresponding holes 56*a* and 56*b* (or recesses 95*a* and 95*b*) to enhance the ability of base plate 32 to flex or deform relative to top plate 34 while transmitting torque from top plate assembly 34 to base plate 32. The fully open and operational position of closure 30 is shown in FIGS. 1C and 2E.

In the fully open position, protrusions 81 (not shown in FIGS. 1C and 2E but shown in FIG. 6) are located and sized to contact the underside of center panel 16 or, preferably, to contact curl 22. Protrusions 81 act as spacers to increase the angle at which base plate 32 is oriented, and therefore increase the area at which the air can rush into can headspace during pouring. This increased vent area for inrushing air diminishes the glugging effect and increases the flow rate during pouring.

Figure 8A:
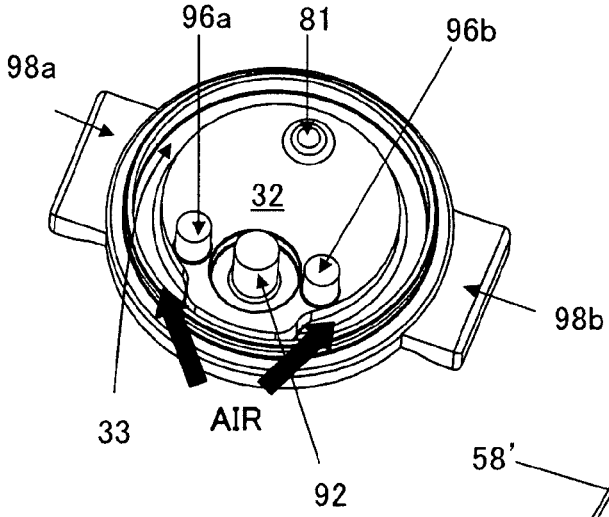
FIG. 8A is a perspective view of a base plate having vent slots.
Figure 8B:
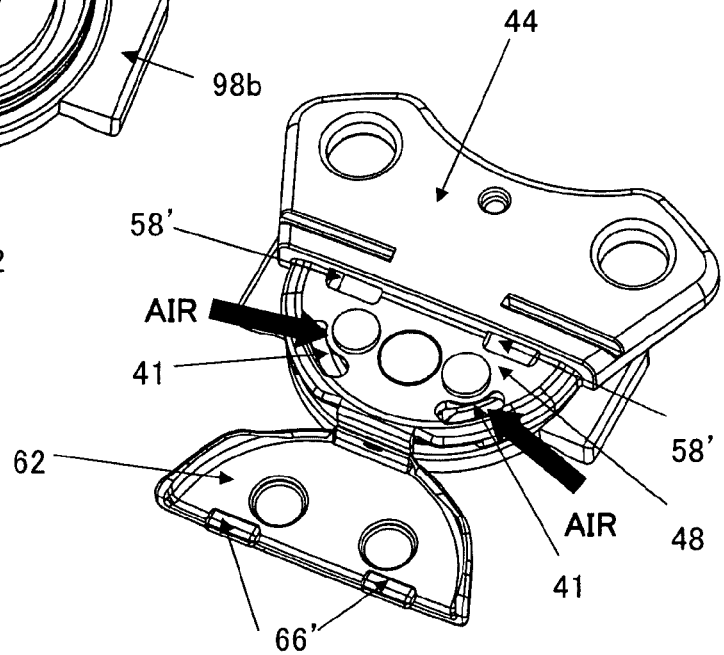
FIG. 8B is a perspective view of an alternative top late arrangement suitable for use with the base plate shown in FIG. 8A having vent slots which allow air between the top plate and the base plate.
Figure 8C:
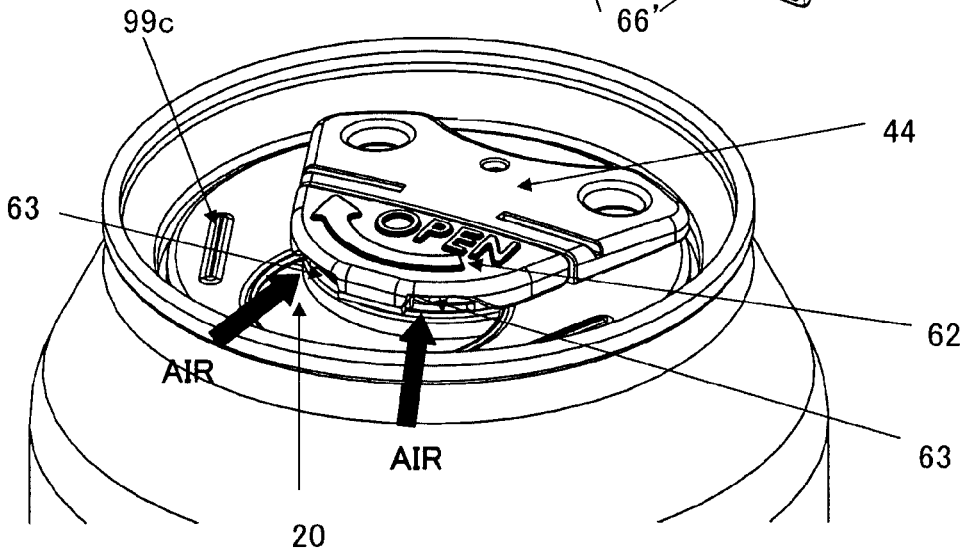
FIG. 8C is an isometric view of the closures shown in FIGS. 8A and 8B when assembled onto a can end/body, illustrating vent arches in the assembled closure to enable air to enter the closure, when the top plate and base plate are arranged in a venting position.

FIGS. 8A, 8B and 8C illustrate an embodiment of the resealable can end by which venting of the closure may be further enhanced. Base plate 32, as shown in FIG. 6 may be provided with a vent groove 33, which directs the inrushing air into the headspace of the beverage can 1 (see FIG. 1C). Additionally, closure 30*a* (see FIGS. 10A and 10B) is provided with vent slots 41 (see FIG. 8B), which together with vent arches 63 define a flow path for the inrushing air from the ambient conditions outside the beverage can 1 to the headspace inside the beverage can.

Figure 9A:
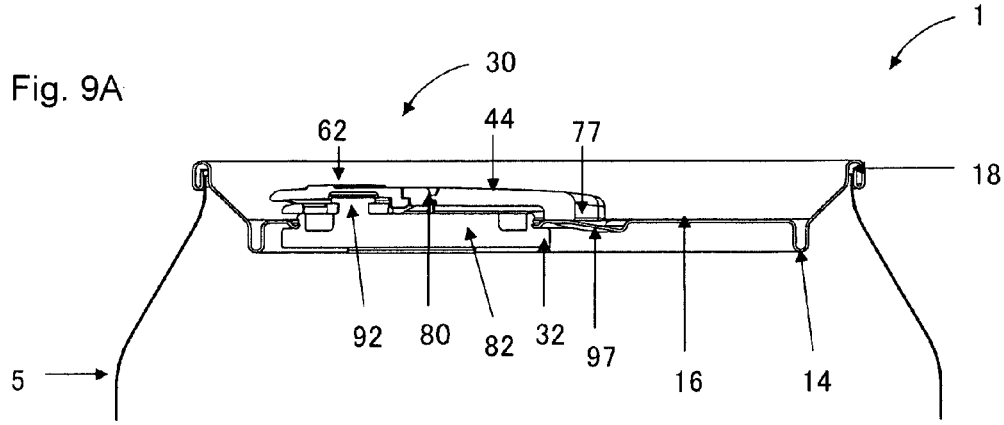
FIG. 9A is a cross sectional view of a an alternative closure assembled onto a can end/body in an unopened position.
Figure 9B:
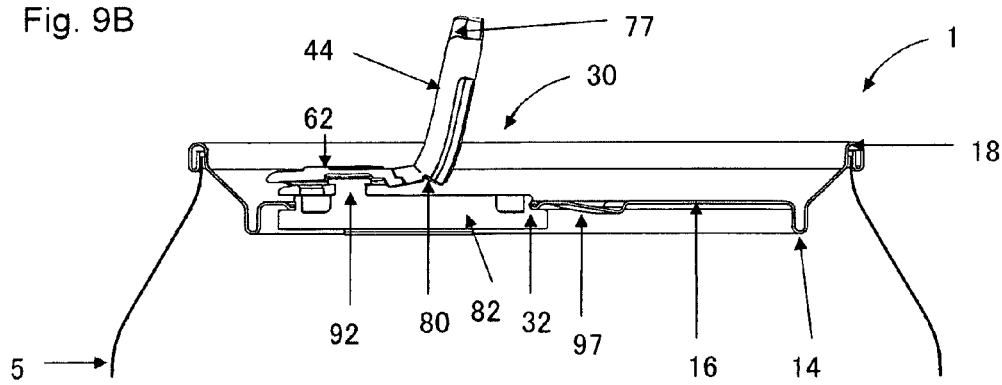
FIG. 9B is a cross sectional view of the closure shown in FIG. 9A upon reclosing the can with the tab lifted to reengage the bore seal and face seal.

Referring to FIGS. 9A and 9B, to reclose closure 30, a user grasps tab 77 and pushes or slides closure 30 over aperture 20 until ring 86 aligns with center panel aperture 20. The user then pulls generally upwardly on tab 77 and tab plate 44 with a force sufficient to deflect ring 86 such that bead 88 snaps over curl 22.

In this way, the peripheral rim of curl 22 engages ring surface or recess 90 and the lower portion of curl 22 engages the upper face of base plate flange 84, thereby recreating bore seal 36 and face seal 38 and resealing the closure. As dissolved gases in the beverage move from the liquid into the headspace beneath can end 10, the pressure in the headspace increases above atmospheric pressure. The resultant force on base plate 32 creates an upward force on flange 84, which enhances face seal 38.

Referring to FIG. 9B, as the user continues to lift tab 77, deflecting tab plate 44 the hinge 80 is opened to its full extent and further lifting of tab plate 44, causes the plate member 82 to cover and seal the aperture 20 as previously described.

For embodiments in which the ring has a bead 88, the action of bead 88 moving over curl 22 may create an audible click, which provides an indication to a user that the closure has been reclosed and resealed. The length, thickness, shape, and material properties may be chosen to enhance this audible click. The inventors notice that the click is louder than expected, and surmise that the center panel acts as a portion of a sound box to amplify the click.

FIGS. 10A through 12B illustrate variations of the top plates of resealable closures. Closures 30*a*, 30*b*, and 30*c* illustrate configurations of the center panels and upper portions of the closure to provide, among other things, visual cues to a user during the reclosing process as to the proper position of the closure.

FIGS. 10A and 10B illustrate a closure 30*a* having a cover plate 42*a* and tab plate 44*a* that pivots about hinge 80*a*. Tab 44*a* includes concave recesses 45*a*. Optionally, the center panel may include recesses (not shown in the figures) into which the underside of recesses 45*a* fit into. The center panel 16*a* includes a recess 97*a* to ease access to the distal end of tab 44*a* by a user's finger and embosses 99*a* that can be aligned with a waist portion of the closure 30*a*. In this regard, embosses 99*a* provide a visual indication to a user that closure 30*a* is in proper position for reclosing when embosses 99*a* are aligned with the waist or other visual indicator of closure 30*a*.

FIGS. 11A and 11B illustrate closure 30*b* having a cover plate 42*b* and tab plate 44*b* that pivots about hinge 80*b*. Center panel 16*b* includes a recess 97*b* to enhance finger access. The location of panel aperture (not shown in FIGS. 11A and 11B) and configuration of cover plate 42*b* is chosen such that in its closed position, an arcuate perimeter of closure 30*b* is aligned with the panel reinforcing bead, which provides a visual indication to a user that closure 30*b* is in proper position during the reclosing process.

Figure 12A:
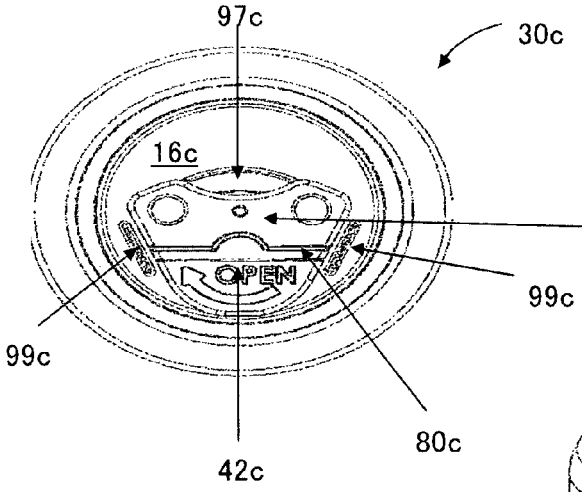
FIG. 12A is a top view of a third alternative top plate configuration, in a closed position, that may be employed with first embodiment closure.
Figure 12B:
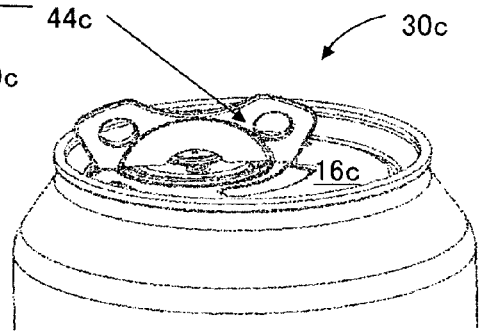
FIG. 12B is a perspective view of the top plate configuration shown in FIG. 12A showing the closure in an intermediate, venting position.
Figure 13A:
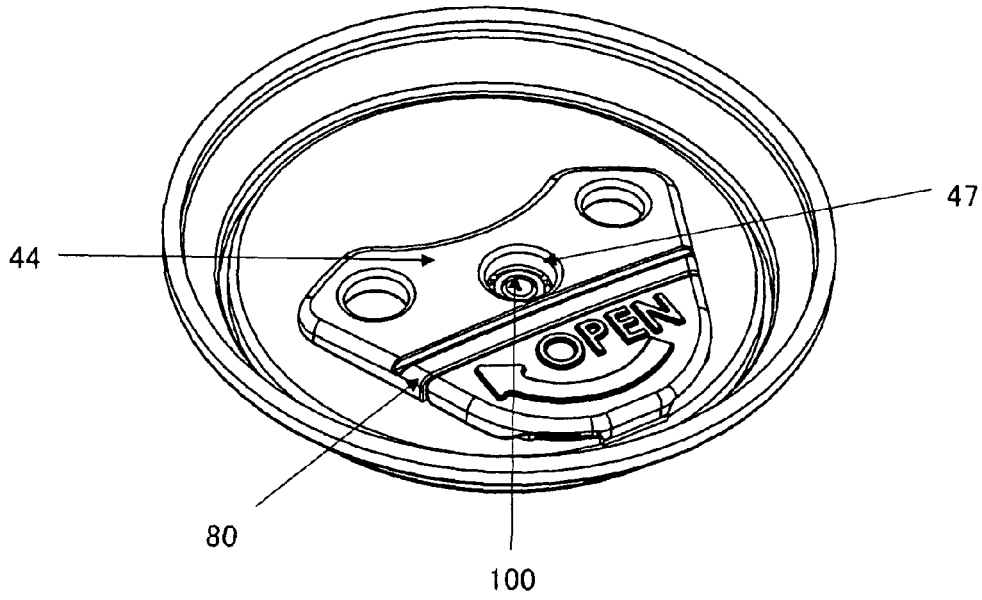
FIG. 13A is a perspective view of the top plate configuration shown in FIG. 10A having an alternative structure for tamper evidence (TE) in a closed position.
Figure 13B:
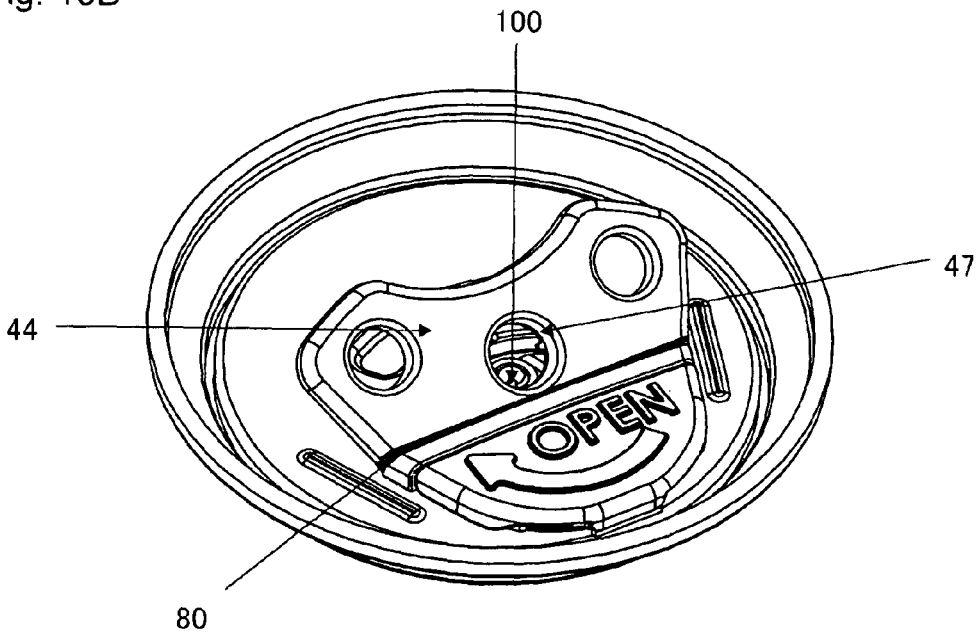
FIG. 13B is a perspective view of the top plate configuration shown in FIG. 13A I which the alternative TE structure has been activated.
Figure 13C:
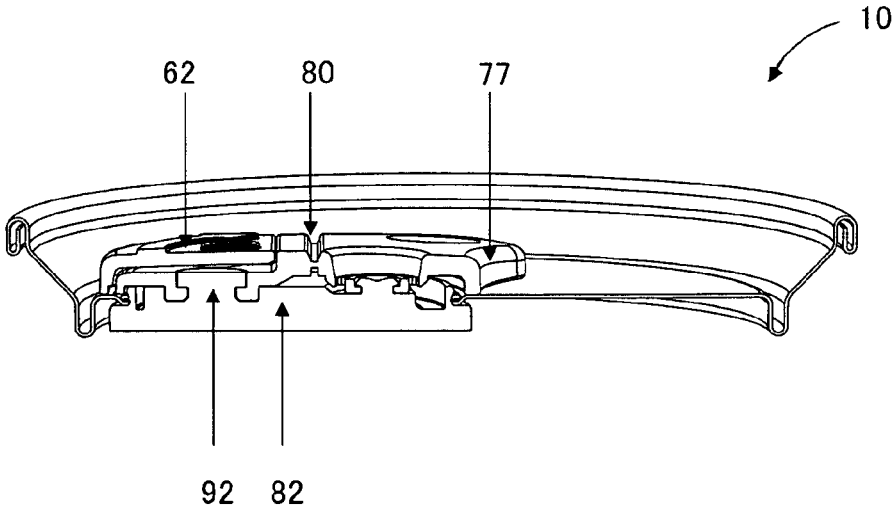
FIG. 13C is a cross sectional view of the top plate configuration shown in FIG. 13A having an alternative structure for tamper evidence (TE) in a closed position.
Figure 13D:
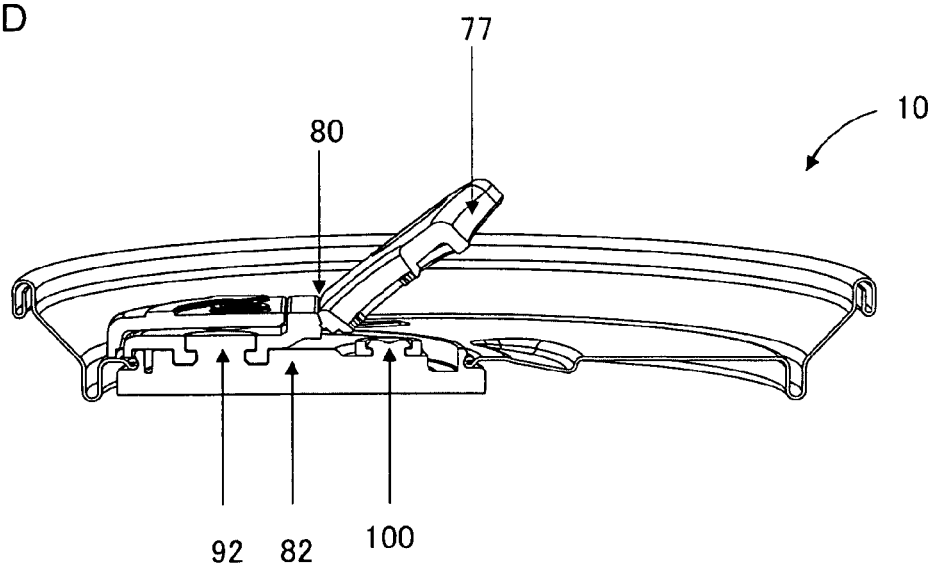
FIG. 13D is a cross sectional view of the top plate configuration shown in FIG. 13A in which the alternative TE structure has been activated.

FIGS. 12A and 12B illustrate closure 30*c* having a cover plate 42*c* and tab plate 44*c* that pivots about hinge 80*c*. Center panel 16*c* includes a recess 97*c* to enhance finger access. Recess 97*c* is curved at approximately the same curvature as the distal edge of tab plate 44*c*. A pair of straight embosses 99*c* are formed on opposing sides of closure 30*c* in center panel 16*c*. Embosses 99*c* are angled to match the angle formed by opposing edges of closure 30*c*. In this regard, the corresponding curvatures of recess 97*c* and the distal edge of tab plate 44*c* and the embosses that bracket closure 30*c* provide a visual indicator to a user during the reclosing process that closure 30*c* is in proper position.

The operation of closures 30*a*, 30*b*, and 30*c* is described, for simplicity, with respect to the reference numerals for closure 30*a*. It is understood that the description also applies to the operation of closures 30*b* and 30*c*. The configuration of hinge 80*a* limits the magnitude of pivoting of tab plate 44*a* to 90 degrees such that tab plate 44*a* cannot pivot significantly past the upright position. To accomplish this limit, the hinge preferably is formed near the bottommost surface of tab plate 44*a*.

While tab 44*a* is in its fully upright position, its wing-nut-like shape, in which its opposing ears protrude above its lower center, provides a cue for turning. Further, to actuate tab 44*a* from its fully open position to the closed position, a user may merely pull or push tab 44*a* toward the close position. Upon proper alignment, the torque created by the user force applied near the top of tab 44*a* may pull the base plate up to engage the bore seal.

FIGS. 13A-13D show view of an alternative tamper evidence (TE) structure, which may incorporated into the closure either to replace or in addition to the stress whitening previously described. This TE structure comprises at least one TE rivet 100, which is accommodated in one or more associated holes 47 on the tab plate 44. The advantage of this TE over previous proposals is that it is impossible to lift the tab plate 44 to achieve venting or to slide the closure open, without breaking the TE structure 100, 47.

The TE arrangement is also advantageous, because the tab plate 44 is held down on the closure, even when the beverage can 1 is pressurized and thus there is less risk of "tab over chime". This alternative TE structure 100, 47 is visibly evident to the user and may be enhanced by the use of different colors for the TE rivet 100 and the tab plate 44. The TE bridges between the TE rivet 100 and the hole 47 in the tab plate 44 may be arranged so that they break successively, to minimize the opening force. Furthermore, the TE bridges may be tapered so that they remain on the TE rivet 100 rather than in the hole 47 on the tab plate 44.

The TE rivet 100 is recessed into the tab 44 and the hole 47 is small enough to prevent finger access for accidental opening of the tab plate 44. The TE rivet 100 is recessed into the tab plate 44 so that when the closure slides open it does not catch the double seam 18. the top of the TE rivet 100 acts to tilt the plate member 82 and provide an air vent path into the headspace during dispensing of the product.

FIGS. 14A through 21B illustrate a another embodiment of recloseable and resealable end 110, which includes a peripheral wall 112, a countersink 114 at the base of wall 112, a center panel 116, and a closure 130. End 110 has an aperture 120 formed in center panel 116 about a curl 122, which may prevent a user from being cut by a sharp, raw edge. Curl 122 also interacts with closure 130 to form a seal, when closure 130 is in its closed position.

Closure 130 includes a base plate 132 and a top plate assembly 134, and forms a bore seal 136 and a face seal 138 with curl 122. Top plate assembly 134 includes a tongue plate 140, a cover plate 142, and a tab plate 144. In its assembled state, tongue plate 140, is located below cover plate 142 and above and base plate 132. A hinge 146 connects tongue plate 140 to cover plate 142.

Figure 14A:
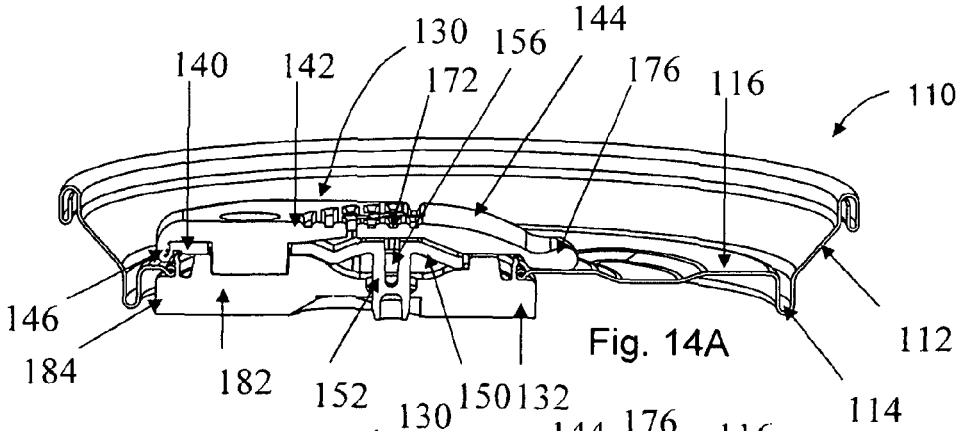
FIG. 14A is a perspective cross sectional view of an alternative closure assembled onto a can end/body in its fully closed position and having a vent plug biased towards its sealed position by a spring.

Tongue plate 140 includes an aperture 149, which in the embodiment shown in FIG. 14A is a slot. Tongue plate 140 extends from hinge 146 and includes a spring 150 from which a plug 152 downwardly extends. Plug 152 includes a longitudinal slot-like opening that forms a pair of opposing windows 156. Windows 156 open at the upper end of plug 152. A continuous circular sealing portion 157 is below windows 156. When the vent plug 152 is in its closed position, the sealing portion 157 seals a vent aperture 191. However, when the vent plug 152 is in its venting position, the windows 156 form vent pathways or a fluid connection between the headspace of the beverage can 1 and the external environment.

Cover plate 142 includes a structural portion or dome plate having a skirt and a cut-out to receive a lever arm, as explained below. One or more rivets 192 extend downwardly from the underside cover plate 142 through aperture 149.

Tab plate 144 includes a structural portion or dome plate, which preferably is arcuate and includes a skirt about its periphery. A lever arm 173 extends from dome plate into the cutout formed in dome plate. A tab 176 extends outwardly from the dome plate opposite lever arm 173. As tab 176 is lifted by a user to open the can, lever arm 173 pushes vent plug 152 against spring 150 and exposes windows 156, which form vent pathways between the headspace of the beverage can 1 and the external environment. As tab 176 is lifted further closure seals 132 and 138 are disengaged and the closure may be opened, exposing aperture 120 in the center panel 116.

Upon reclosing, a user re-engages closure seals 132 and 138 by manipulating tab 176 and spring 150 returns vent plug 152 to it's sealed position.

A pair of side supports 181 extend downwardly from the underside of lever arm 173 to stiffening the lever arm. The distal end of tongue plate 140 is located between side supports 181. Tab plate 144 includes a weakening or groove 180 formed therein.

Figure 14B:
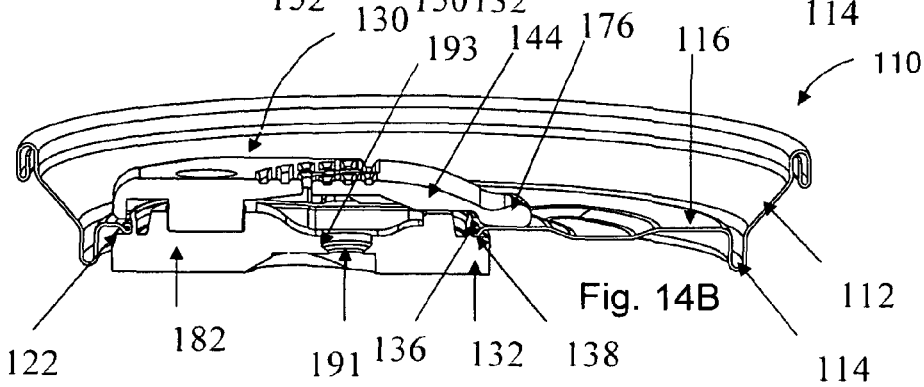
FIG. 14B is a perspective cross sectional view of the closure shown in FIG. 14A with the spring and vent plug removed, for clarity.
Figure 16:
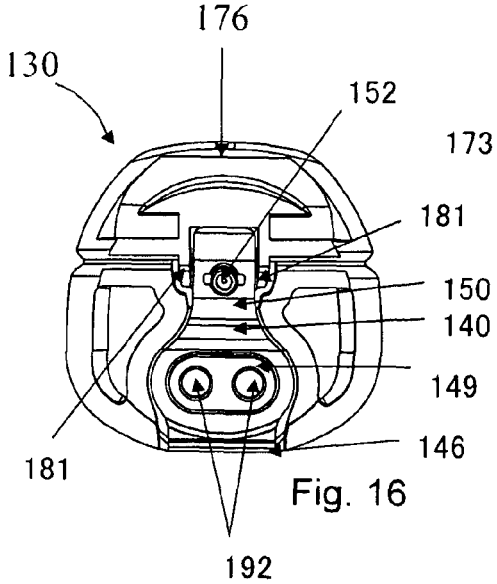
FIG. 16 is a bottom view of the closure shown in FIG. 14A with the base plate removed for clarity.
Figure 15:
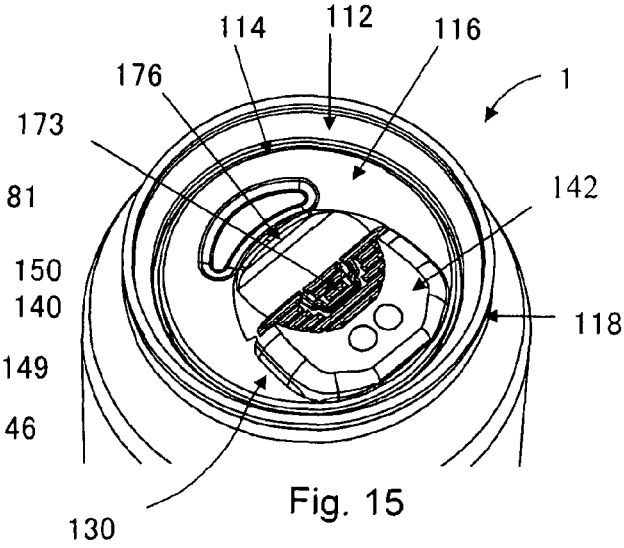
FIG. 15 is a perspective view depicting the closure shown in FIG. 14A affixed to a can body.
Figure 17A:
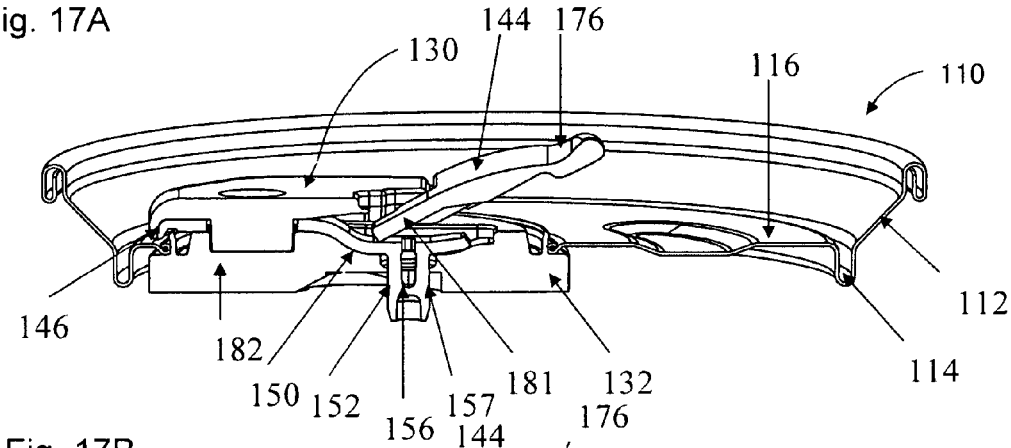
FIG. 17A is a perspective cross sectional view of a resealable can end with the closure shown in FIG. 14A in it's intermediate, vented position.
Figure 17B:
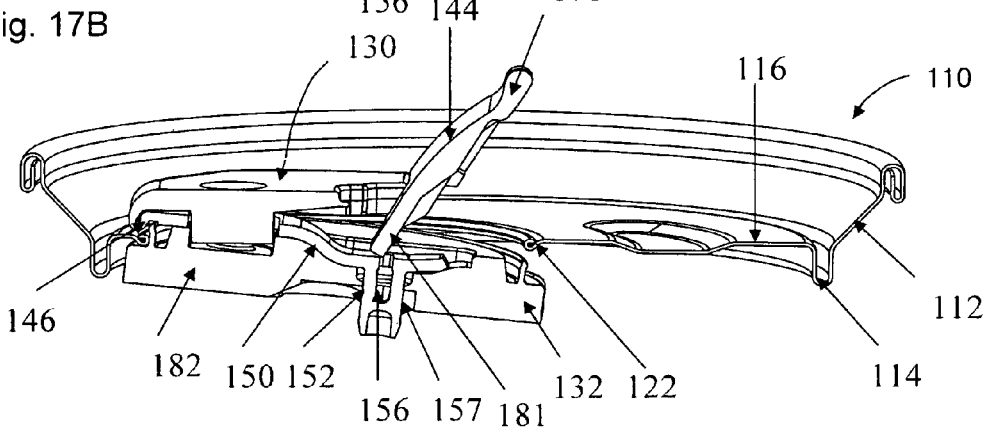
FIG. 17B is a perspective cross sectional view of a resealable can end with the closure shown in FIG. 14A in another intermediate position in which the seals are disengaged.
Figure 17C:
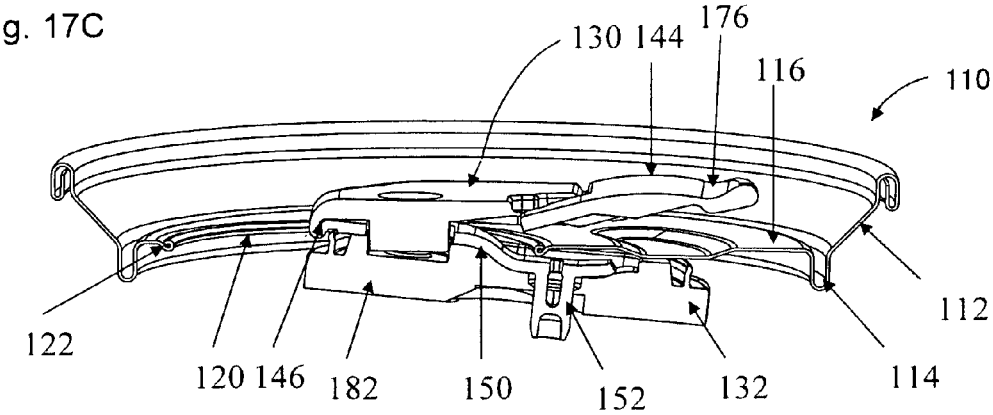
FIG. 17C is a perspective cross sectional view of a resealable can end with the closure shown in FIG. 14A in it's fully open position and the aperture exposed.
Figure 18A:
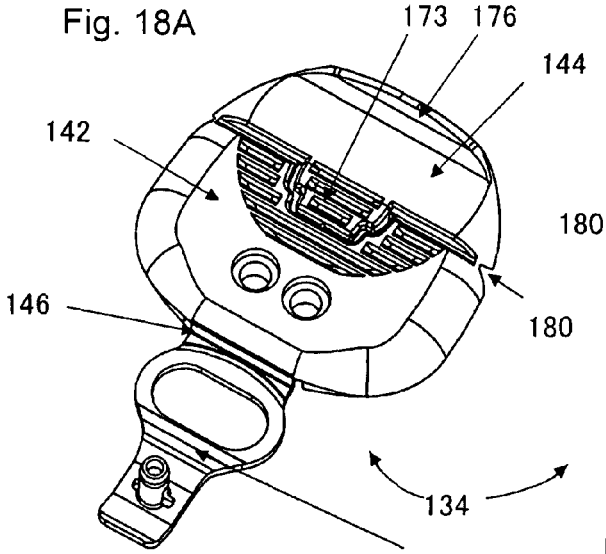
FIG. 18A is a top perspective view of the top plate of the closure shown in FIG. 14A.
Figure 18B:
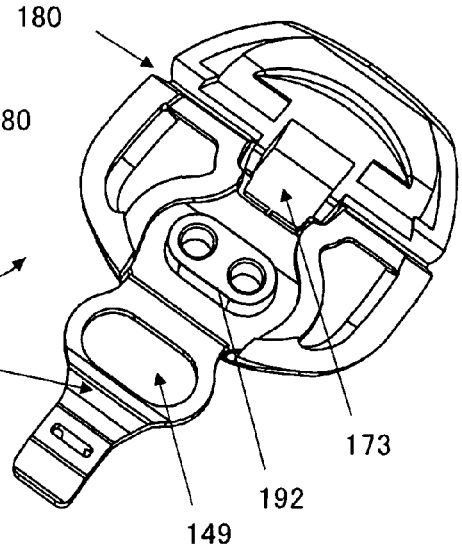
FIG. 18B is a bottom perspective view of the top plate of the closure shown in FIG. 14A.
Figure 19A:
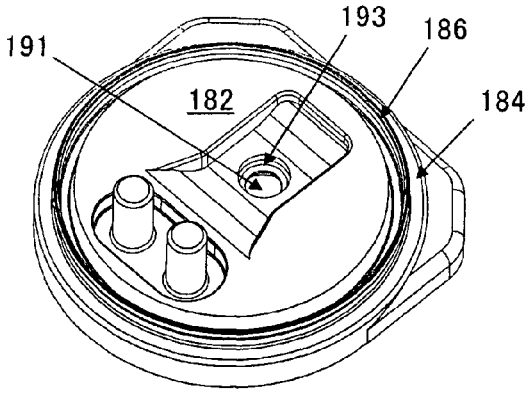
FIG. 19A is a top perspective view of the base plate of the closure shown in FIG. 14A.
Figure 19B:
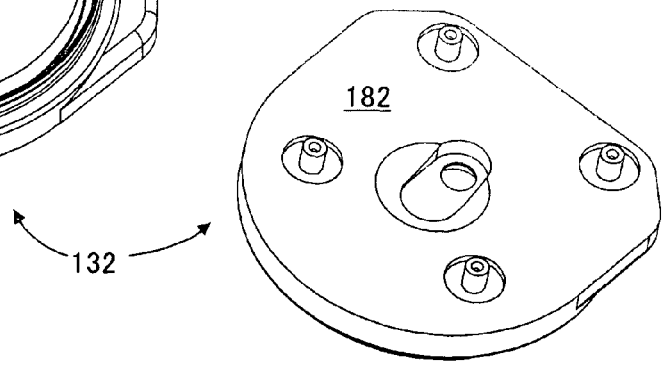
FIG. 19B is a bottom perspective view of the base plate of the closure shown in FIG. 14A.

Referring to FIG. 19A, base plate 132 includes a planar (or nearly planar) plate member 182, a continuous, circumferential flange 184 extending from a periphery of plate member 182, and a continuous ring 186 extending upwardly from flange 184. Base plate 132, flange 184, and ring 186 preferably have approximately the same shape as aperture 120. Accordingly, in the embodiment shown, base plate 132, flange 184, and ring 186 are circular to match the shape of aperture 120. Base plate 132 also includes an aperture 191 that forms a sealing surface 193, as best shown in FIG. 14B, from which the majority of tongue plate 140 is removed for clarity.

In its assembled state, base plate 132 is located on the underside of center panel 116 such that the flat surface of flange 184 is in contact with the underside of curl 122 to form face seal 138, and the outboard portion of ring 186 contacts the innermost portion of curl 122 to form bore seal 136.

Plug 152 extends through aperture 191 in base plate 132 and is retained by a rivet head 154. Plug 152 may be molded in a cylindrical shape and deformed during assembly with base plate 132 or may be formed with an olive or bead (not shown in the figures) such that plug 152 is inserted through aperture 191 in a snap fit. Aperture surface 193 contacts continuous sealing surface 157 of plug 152 to seal aperture 191 while closure 130 is in its original or reclosed position. In the configuration shown in FIG. 14A, spring 150 exerts an upward force on plug 152 that tends to return the plug to its unvented state.

Figure 20A:
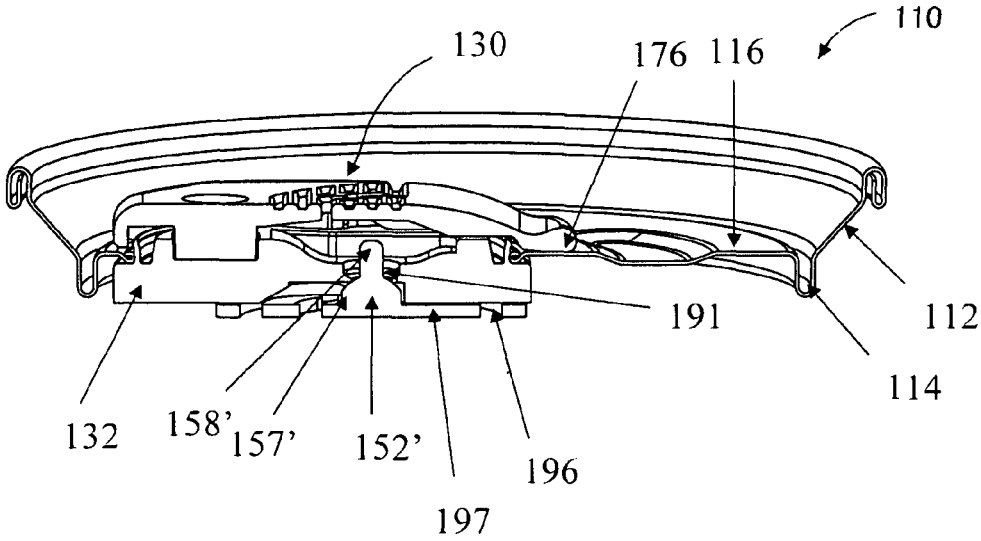
FIG. 20A is a perspective cross sectional view of another embodiment of a resealable can end having a closure in its fully closed position and having a vent plug biased towards its sealed position by a spring.
Figure 20B:
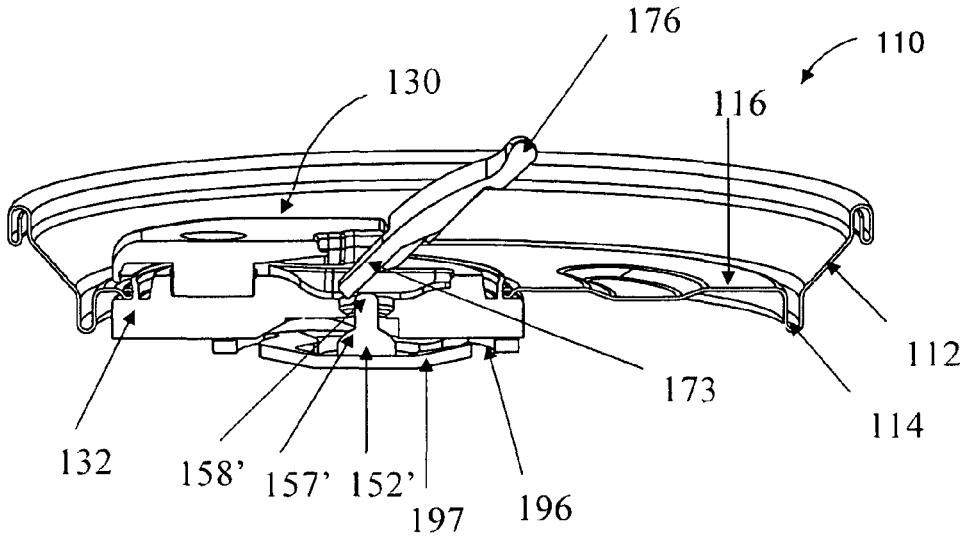
FIG. 20B is a perspective cross sectional view of the resealable can end shown in FIG. 20A with the closure in s intermediate, vented position.
Figure 21A:
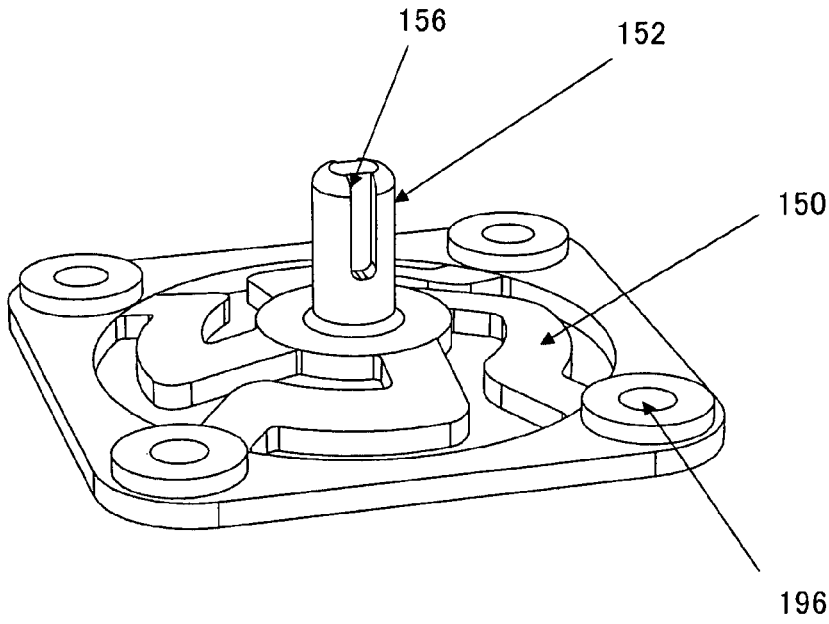
FIG. 21A is a perspective view of a spring plate in its "as moulded", unstressed state.
Figure 21B:
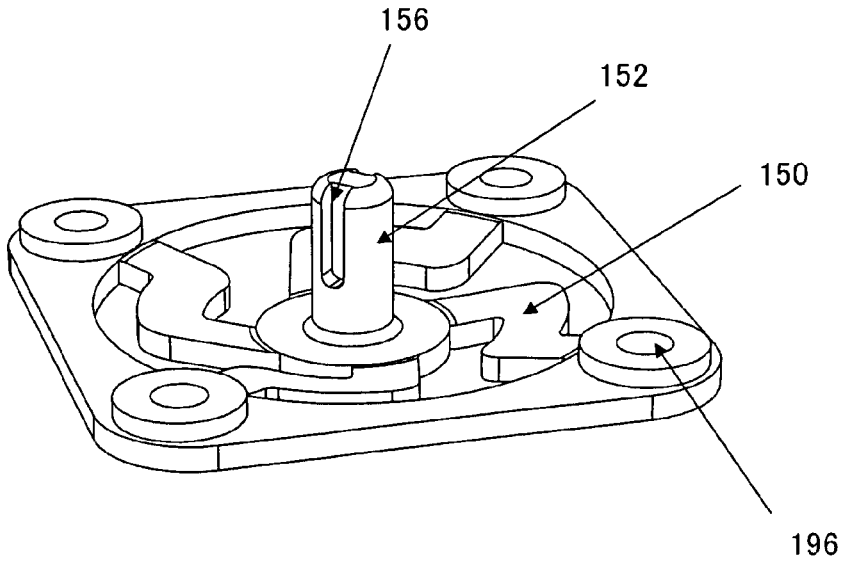
FIG. 21B is a perspective view of the spring plate shown in FIG. 21A in its "actuated", loaded state.
Figure 22:
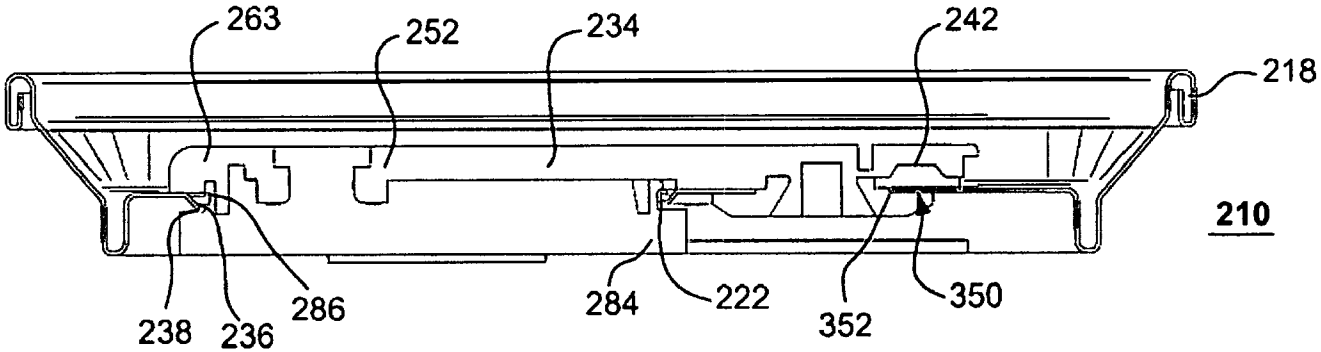
FIG. 22 is a perspective cross sectional view of another embodiment closure in its fully closed position.
Figure 23:
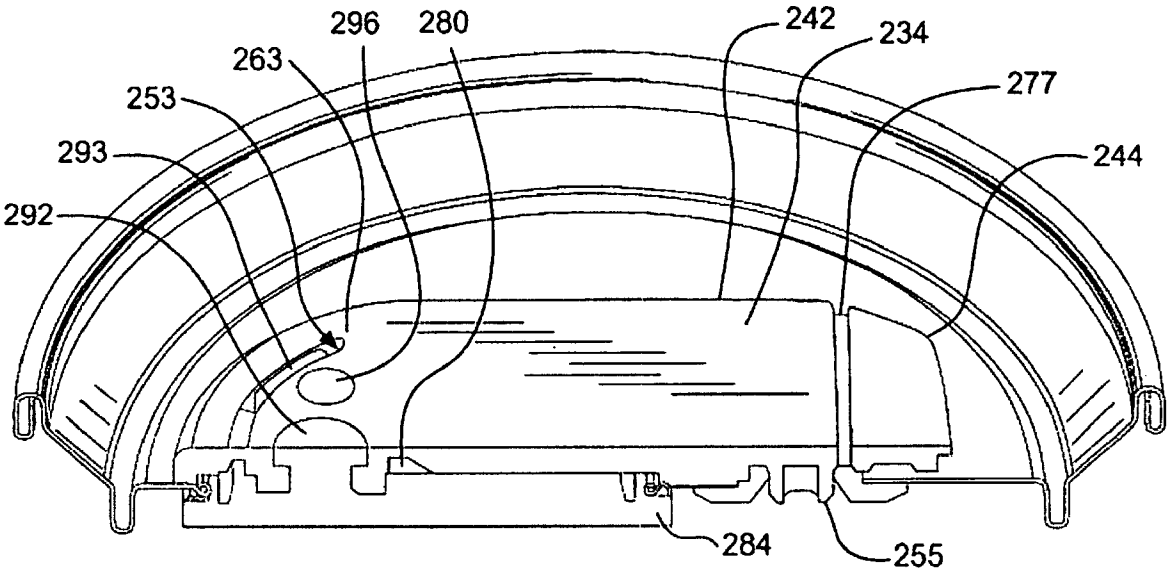
FIG. 23 is a cross sectional view of the closure shown in FIG. 22.

FIGS. 20A and 20B show another embodiment of a closure plug assembly 152' that includes a sealing portion 157' and a location portion 158' of reduced diameter, adapted to ensure that the plug assembly remains aligned with aperture 191, but provides a vent pathway between the headspace inside the can and the external environment. Plug 52' has a base plate 195, rivet holes 196, and a spring 197 to bias plug 152' towards its sealed position. Plug base plate 195 is attached to the underside of the closure base plate by rivets that extend through holes 196. Spring 197 urges plug 152' upwardly such that a continuous sealing surface of plug 152' engages and seals against the aperture 191. Upon lifting of tab 176 by a user, a lever arm 173 is actuated to push plug 152' downwardly to vent and open, as will be understood based on the discussion of plugs above.

Referring to the second embodiment closure 130, to actuate closure 130 from its original, closed position to a vented, intermediate position, tab 176 is lifted upwardly to pivot tab plate 144 about the hinge formed by groove 180. The bottom surfaces of side supports 181 contact the upper surface of base plate member 182 as lever arm 173 pivots counterclockwise. Arm 173 contacts plug 152 and drives it downwardly until windows 156 are exposed beneath center panel 116 (such as, for example, corresponding to approximately 30 degree rotation of tab 176), which enables communication between the headspace in the can and the ambient atmosphere through window 156. In this way, internal can pressure is controllably vented before fully opening closure 130. However, location portion 158' remains aligned in the aperture 191.

After venting, a user may rotate tab 176 more fully, such as approximately to 45 degrees, and optionally apply a downward force either by directly contacting and pushing onto closure 130 or by transmitting a force through the tab 176. The action of tab 176 and the optional downward force disengages seals 136 and 138. Rotation of tab 176 and the optional downward force may continue until base plate 132 easily clears center panel 116 to enable sliding of closure 130 to expose aperture 120. The gap between the top of ring 186 and curl 122 is approximately 0.76 mm (0.0299 inch).

To reclose, a user may grasp tab 176 and pull or push closure 130 until it is aligned with aperture 120, then put upwardly to engage seals 136 and 138.

FIGS. 22 through 25 illustrate another embodiment of recloseable and resealable end 210, which includes a peripheral wall 212, a countersink 214 at the base of wall 212, a center panel 216, and a closure 230. End 210 includes an aperture 220 formed in center panel 216 about a curl 222.

Closure 230 includes a base plate 232 and a top plate assembly 234, and forms a bore seal 236 and a face seal 238 with curl 222. Top plate assembly 234 includes a cover plate 242 and a tab plate 244.

Cover plate 242 includes a pivotable structural portion or dome plate 262 and an anchor plate 263. Dome plate 262 and anchor plate 263 are separated by a groove 280 that functions as a living hinge, and may have the stress whitening, tamper evident features described above.

Cover plate 242 includes a cylindrical pin 255 extending downwardly from its underside. Cover plate 242 is separated from tab plate 244 by a living hinge 277, which may function as a living hinge and as tamper evidence. Anchor plate 263 includes a rivet aperture 252 and an arcuate slot 253 therethrough.

Figure 25:
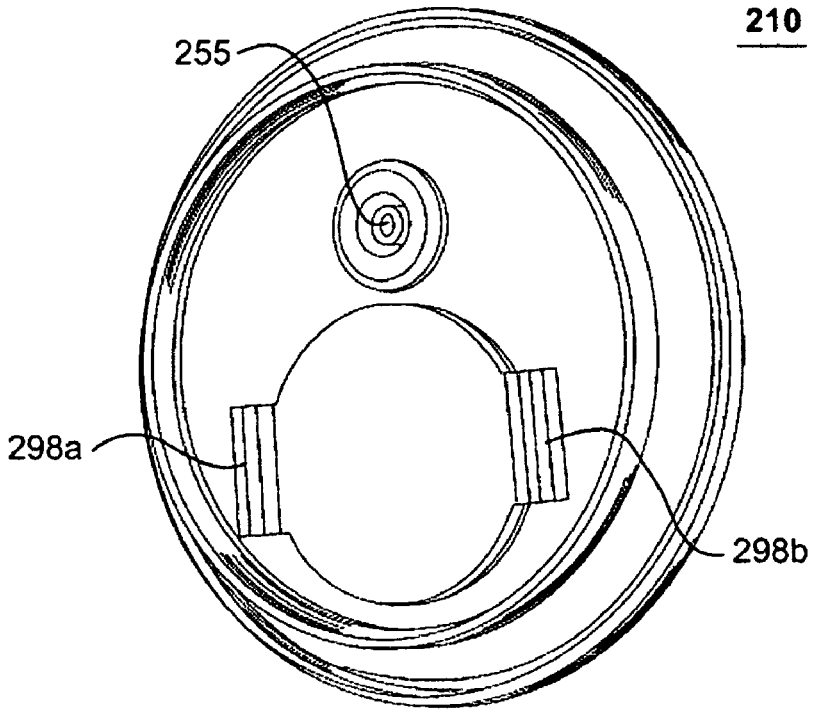
FIG. 25 is a bottom perspective view of the closure shown in FIG. 22.
Figure 24:
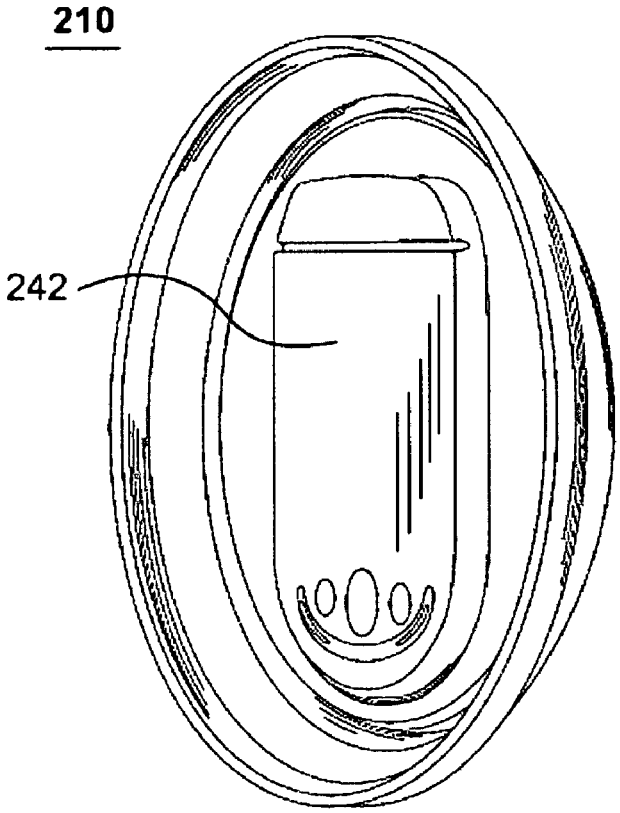
FIG. 24 is a top perspective view of the closure shown in FIG. 22.

Base plate 232 includes a planar (or nearly planar) plate member 282, a continuous, circumferential flange 284 extending from a periphery of plate member 282, and a continuous ring 286 extending upwardly from flange 284. A pair of wings 298*a* and 298*b* extend on opposite sides of flange 84, as shown in FIG. 25.

Base plate 232, flange 284, and ring 286 preferably have approximately the same shape as aperture 220. Base plate 232 includes a rivet 292 and a pair of arcuate tongues 293 that extend upwardly from plate member 282.

Center panel 216 also includes an aperture 350 that is spaced apart from pour aperture 220. A grommet or insert 352 is affixed into aperture 350, preferably in a press fit. Insert 352 has a through hole 253 defined by a sealing surface 254. Preferably, base plate 232 and insert 352 are injection molding in a unitary piece such that plate 232 and insert 352 are held together by bridges. Upon application of the unitary, injection molded part to center panel 216, the bridges are ruptured, which enables base plate 232 to function as described herein.

In its assembled state, base plate 232 is located on the underside of center panel 216 such that the flat surface of flange 284 is in contact with the underside of curl 222 to form face seal 238, and the outboard portion of ring 286 (preferably recess 290) contacts the innermost portion of curl 222 to form bore seal 236.

Rivet 292 extends through rivet aperture 350 in anchor plate 263 to affix the top and bottom plates together. Arcuate tongues 293 extend into arcuate slots 253. Pin 255 is located in insert aperture 250 such that pin 255 forms a seal with aperture sealing surface 254.

To actuate closure 230, a user may place a finger beneath tab plate 244 to rotate dome plate 262 of cover plate 242 upwardly about hinge 280, then translate closure 230 relative to opening 220. Tabs 298*a* and 298*b* preferably are not employed for the opening process, but rather are used as guides during assembly and application of closure 230 to center panel 216.

From the vented position, the user continues to grip tab plate 244 and pulls or slides closure 230 to expose end aperture 220 to enable drinking or pouring from the can end. Thus, closure 230 may be actuated by gripping tab plate 244, twisting it, and pulling it, without the user letting go of tab plate 244.

To the extent necessary, the attachment of top plate 234 to base plate 232 by rivet 292 has the inherent capability of flexing to enable base plate 232 to ride underneath center panel 216 and to enable tab plate 244 to ride overtop center panel 216.

To reclose closure 230, a user grasps tab plate 234 and pushes or slides closure 230 over aperture 220 until ring 286 aligns with center panel aperture 220. The user then pulls generally upwardly on tab plate 244 with a force sufficient to deflect ring 286 such that bead 288 snaps over curl 222.

The present inventions are illustrated by the description of several embodiments. The present invention, however, is not limited to the particular embodiments described herein. Rather the present invention encompasses any combination of the features of any of the embodiments and natural variations thereof, as will be understood by persons familiar with closure technology.

We claim:

1. A can end combination comprising a metal can end and resealable closure coupled to the can end, the can end comprising a peripheral wall and a center panel, the center panel including an upper surface, an opposing lower surface, and an aperture formed therethrough;

the closure comprising a base plate and a top plate coupled to the base plate at a first location, the base plate includes a bead, the closure having (i) a sealed position in which at least one of the base plate and top plate contact the center panel about the aperture to form a seal, (ii) an intermediate position in which the closure is proximate the aperture but not sealed, and (iii) a fully open position in which the aperture is exposed to enable pouring liquid through the aperture;

the base plate being downwardly moveable relative to the top plate when moved from the sealed position to the intermediate position;

the base plate and top plate being: (i) translatable together relative to the can end from the intermediate position to the fully open position and (ii) translatable together relative to the can end from the fully open position to the intermediate position;

the base plate being upwardly moveable into engagement with the center panel from the intermediate position into a resealed position forming at least one of a bore seal and a flange seal;

wherein the bead is configured to engage with a rim of the aperture when the base plate is moved into the resealed position to thereby provide an audible "click."

2. The re-sealable can end combination of claim 1, wherein the base plate further includes a wing, adapted to ride on a cam surface to allow relative movement between the base plate and the top plate to enable venting.

3. The re-sealable can end combination of claim 1, wherein the base plate includes one or more protrusions that enhance the inclination of the base plate upon rotation of the top plate relative to the base plate to enable venting.

4. The re-sealable can end combination of claim 1, wherein in the closed position, the base plate includes a continuous flange for forming the face seal with the underside of the center panel, and a continuous upright ring for forming the bore seal with a lip of the aperture.

5. The re-sealable can end combination of claim 1, wherein the top plate comprises a tab plate articulated by a living hinge.

6. The re-sealable can end combination of claim 5 wherein the living hinge is formed by a v-groove formed between the tab plate and an anchor plate, whereby lifting of the tab plate causes the sides defined by the v-groove to contact, and lifting forces applied to the tab plate are transmitted to the anchor plate and thereafter transmitted to the base plate.

7. The re-sealable can end combination of claim 1, wherein the base plate includes at least one vent groove, adapted to define a flow path between the base plate and the top plate during venting.

8. The re-sealable can end combination of claim 1, wherein the top plate includes at least one vent slot, adapted to define a flow path through the top plate during venting.

9. The re-sealable can end combination of claim 1, wherein the base plate includes a rivet that couples the top plate and bottom plate together.

10. The re-sealable can end combination of claim 9, wherein the rivet is hidden from view by a cover.

11. The re-sealable can end combination of claim 1, wherein one of the top plate and the bottom plate includes at least one post that is insertable into an aperture formed in the other of the top plate and the bottom plate to prevent rotation of the top plate relative to the base plate.

12. The re-sealable can end combination of claim 1, wherein (i) the top plate includes a tab having at least one downward extending protrusion, (ii) the center panel includes at least one recess, and (iii) the protrusion of the tab is adapted to fit into the recess of the center panel.

13. The re-sealable can end combination of claim 1, wherein the center panel includes embosses to provide an indication to a user that the closure is in proper position for reclosing.

14. The re-sealable can end combination of claim 1, wherein the closure includes a tamper evidence structure.

15. The re-sealable can end combination of claim 14, wherein the tamper evidence structure includes a rivet that engages a hole on a tab of the top plate upon application, the tab being removable from the rivet upon initial opening.

16. The can end combination of claim 1, wherein (i) the top plate comprises a cover plate and an anchor plate, and (ii) the cover plate is rigid relative to the anchor plate to facilitate flexing of the anchor plate during the opening process.

17. The can end combination of claim 1 wherein a downward force for opening is directly applied by a user.

18. The can end combination of claim 1 wherein a downward force for opening is by lever action of a tab of the top plate.

* * * * *